US010221655B2

(12) United States Patent
Phi et al.

(10) Patent No.: US 10,221,655 B2
(45) Date of Patent: Mar. 5, 2019

(54) WELLBORE FLOW-CONTROL ASSEMBLIES FOR HYDROCARBON WELLS, AND SYSTEMS AND METHODS INCLUDING THE SAME

(71) Applicants: Manh V. Phi, Fountain Valley, CA (US); Stuart R. Keller, Houston, TX (US)

(72) Inventors: Manh V. Phi, Fountain Valley, CA (US); Stuart R. Keller, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 964 days.

(21) Appl. No.: 14/431,182

(22) PCT Filed: Sep. 13, 2013

(86) PCT No.: PCT/US2013/059740
§ 371 (c)(1),
(2) Date: Mar. 25, 2015

(87) PCT Pub. No.: WO2014/077949
PCT Pub. Date: May 22, 2014

(65) Prior Publication Data

US 2015/0315872 A1 Nov. 5, 2015

Related U.S. Application Data

(60) Provisional application No. 61/726,963, filed on Nov. 15, 2012.

(51) Int. Cl.
*E21B 34/10* (2006.01)
*E21B 43/14* (2006.01)
(Continued)

(52) U.S. Cl.
CPC ..... *E21B 34/10* (2013.01); *E21B 33/138* (2013.01); *E21B 34/063* (2013.01); *E21B 34/08* (2013.01);
(Continued)

(58) Field of Classification Search
CPC ..... E21B 34/06; E21B 34/063; E21B 34/08; E21B 34/085; E21B 34/10; E21B 34/105; E21B 34/106; E21B 2034/002
See application file for complete search history.

(56) References Cited

U.S. PATENT DOCUMENTS

2002/0007949 A1 1/2002 Tolman et al.
2008/0000639 A1 1/2008 Clark et al.
(Continued)

FOREIGN PATENT DOCUMENTS

WO WO 2013090289 A1 6/2013

OTHER PUBLICATIONS

Baumgarten et al. (2009), "Multi-Stage Acid Stimulation Improves Production Values in Carbonate Formations in Western Canada," *SPE 126058*, 2009 SPE Saudi Arabia Section Technical Symposium and Exh., 11 pgs.

*Primary Examiner* — D. Andrews
*Assistant Examiner* — Tara E Schimpf
(74) *Attorney, Agent, or Firm* — ExxonMobil Upstream Research Company—Law Department

(57) ABSTRACT

Wellbore flow-control assemblies define a flow-controlled fluid conduit that selectively conveys a fluid flow, including fluid outflow and fluid inflow, between a subterranean formation and a casing conduit. The wellbore flow-control assemblies include a sacrificial flow-control device that defines a first portion of the flow-controlled fluid conduit and a directional flow-control device that defines a second portion of the flow-controlled fluid conduit. The sacrificial
(Continued)

flow-control device resists the fluid flow prior to a flow-initiation event and permits the fluid flow subsequent to the flow-initiation event. The directional flow-control device permits one of fluid outflow and fluid inflow and resists the other.

37 Claims, 13 Drawing Sheets

(51) Int. Cl.

| | |
|---|---|
| ***E21B 34/16*** | (2006.01) |
| ***E21B 34/08*** | (2006.01) |
| ***E21B 43/12*** | (2006.01) |
| ***E21B 33/138*** | (2006.01) |
| ***E21B 34/06*** | (2006.01) |
| *E21B 34/00* | (2006.01) |

(52) U.S. Cl.
CPC ..... *E21B 34/16* (2013.01); *E21B 43/12* (2013.01); *E21B 43/14* (2013.01); *E21B 2034/002* (2013.01)

(56) References Cited

U.S. PATENT DOCUMENTS

| | | | | |
|---|---|---|---|---|
| 2009/0014168 | A1 | 1/2009 | Tips et al. | |
| 2009/0084556 | A1 | 4/2009 | Richards et al. | |
| 2009/0151925 | A1 | 6/2009 | Richards et al. | |
| 2011/0297393 | A1* | 12/2011 | Patel ..... | E21B 34/06 166/373 |

* cited by examiner

WELLBORE FLOW-CONTROL ASSEMBLIES FOR HYDROCARBON WELLS, AND SYSTEMS AND METHODS INCLUDING THE SAME

CROSS REFERENCE TO RELATED APPLICATIONS

This application is the National Stage of International Application No. PCT/US2013/059740, filed Sep. 13, 2013, which claims the benefit of U.S. Provisional Application No. 61/726,963, filed Nov. 15, 2012, the disclosure of which is hereby incorporated by reference.

FIELD OF THE DISCLOSURE

The present disclosure is directed generally to wellbore flow-control assemblies for hydrocarbon wells, and more particularly to hydrocarbon wells and components and/or methods thereof that include the wellbore flow-control assemblies.

BACKGROUND OF THE DISCLOSURE

Well drilling operations may utilize a variety of steps during the formation of, completion of, and/or production from a well, such as a hydrocarbon well. Often, these steps are performed sequentially, with dedicated and/or specialized equipment and/or crews being utilized to perform each of the steps. While such a methodology may be effective, it may be costly and/or time-consuming to implement due to equipment costs, labor costs, and/or time required to remove one piece of equipment from the well and deploy another piece of equipment within the well.

As an illustrative example, and subsequent to formation of a wellbore within a subterranean formation, it may be desirable to circulate drilling fluids, such as drilling mud, from the wellbore, to circulate a completion and/or breaker fluid into the subterranean formation, and/or to pump a wiper plug or other sealing device to a terminal depth of the wellbore. These operations typically involve supplying a fluid stream through a fluid conduit and from a surface region to, or proximal to, a terminal depth of the wellbore and may require a substantially fluid-tight seal within the fluid conduit from the top of the wellbore to the terminal depth of the wellbore.

Traditionally, a casing string, or liner, may be located within the wellbore. However, this casing string often includes a plurality of holes, perforations, passages, and/or other fluid conduits along a length thereof. These fluid conduits may be configured to provide for outflow of a stimulant fluid from the casing string into the subterranean formation and/or inflow of a reservoir fluid from the subterranean formation into the casing string. Thus, any fluid that is supplied to the casing string may leak through these fluid conduits to the subterranean formation, thereby decreasing a flow rate at the terminal end of the wellbore. Therefore, an inner string that does not include holes along a length thereof may be run into the casing string to facilitate providing the fluid to the terminal depth of the wellbore. However, insertion and/or subsequent removal of this inner string may significantly increase the cost and/or time required to complete the well drilling operation.

As another illustrative example, it also may be desirable to perform one or more stimulation operations to stimulate the subterranean formation and increase a potential for production of the reservoir fluid therefrom. These stimulation operations may include providing a stimulant fluid to specific, or target, regions of the subterranean formation and may utilize stimulation ports within the casing string to provide the stimulant fluid from the casing conduit to the target region of the subterranean formation.

However, and subsequent to the stimulation operations, it also may be desirable to control a flow rate of the reservoir fluid into the casing conduit during production of the reservoir fluid from the casing conduit. Typically, a desired flow rate of the reservoir fluid into the casing conduit during production from the subterranean formation is significantly lower than a desired flow rate of the stimulant fluid during stimulation of the subterranean formation. Thus, it may be desirable to decrease and/or restrict a flow rate of the reservoir fluid from the subterranean formation into the casing conduit through the stimulation ports. However, such control may be difficult, costly, and/or time-consuming to implement. Thus, there exists a need for improved systems and methods for completing a well and/or producing a reservoir fluid therefrom.

SUMMARY OF THE DISCLOSURE

Wellbore flow-control assemblies for hydrocarbon wells, systems that include the wellbore flow-control assemblies, and/or methods that utilize the wellbore flow-control assemblies. The wellbore flow-control assemblies define a flow-controlled fluid conduit that selectively conveys a fluid flow, which may include a fluid outflow and/or a fluid inflow, between a subterranean formation and a casing conduit. The wellbore flow-control assemblies include a sacrificial flow-control device that defines a first portion of the flow-controlled fluid conduit and a directional flow-control device that defines a second portion of the flow-controlled fluid conduit. The sacrificial flow-control device resists the fluid flow prior to a flow-initiation event and permits the fluid flow subsequent to the flow-initiation event. The directional flow-control device permits one of the fluid outflow and the fluid inflow and resists the other of the fluid outflow and the fluid inflow.

In some embodiments, the wellbore flow-control assemblies define a production flow path that extends between the casing conduit and the subterranean formation. In some embodiments, the flow-controlled fluid conduit defines a portion, or all, of the production flow path. In some embodiments, the production flow path selectively conveys the fluid inflow from the subterranean formation to the casing conduit and resists the fluid outflow from the casing conduit to the subterranean formation.

In some embodiments, the wellbore flow-control assemblies define a stimulation flow path that extends between the casing conduit and the subterranean formation. In some embodiments, the flow-controlled fluid conduit defines a portion, or all, of the stimulation flow path. In some embodiments, the stimulation flow path conveys the fluid outflow and resists the fluid inflow.

In some embodiments, the wellbore flow-control assemblies define both the stimulation flow path and the production flow path. When the wellbore flow-control assemblies define both the stimulation flow path and the production flow path, the flow-controlled fluid conduit may define the, or the entire, stimulation flow path and a portion of the production flow path. In some embodiments, the wellbore flow-control assemblies further include a bypass conduit that forms a portion of the production flow path and bypasses a portion of the flow-controlled fluid conduit, such as the directional flow-control device.

In some embodiments, the wellbore flow-control assemblies may form a portion of a casing string that extends within a wellbore and defines the casing conduit. In some embodiments, the casing string may include a plurality of wellbore flow-control assemblies. In some embodiments, the systems and methods may include circulating a drilling fluid from the wellbore prior to the flow-initiation event, stimulating the subterranean formation subsequent to the flow-initiation event, and/or producing a reservoir fluid from the subterranean formation subsequent to the flow-initiation event.

DETAILED DESCRIPTION AND BEST MODE OF THE DISCLOSURE

FIGS. 1-12 provide illustrative, non-exclusive examples of wellbore flow-control assemblies 100 according to the present disclosure and/or of systems, apparatus, and/or assemblies that may include, be associated with, be operatively attached to, and/or utilize wellbore flow-control assemblies 100. In FIGS. 1-12, like numerals denote like, or similar, structures and/or features; and each of the illustrated structures and/or features may not be discussed in detail herein with reference to each of FIGS. 1-12. Similarly, each structure and/or feature may not be explicitly labeled in each of FIGS. 1-12; and any structure and/or feature that is discussed herein with reference to any one of FIGS. 1-12 may be utilized with any other of FIGS. 1-12 without departing from the scope of the present disclosure.

In general, structures and/or features that are, or are likely to be, included in a given embodiment are indicated in solid lines in FIGS. 1-12, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Figure 1:
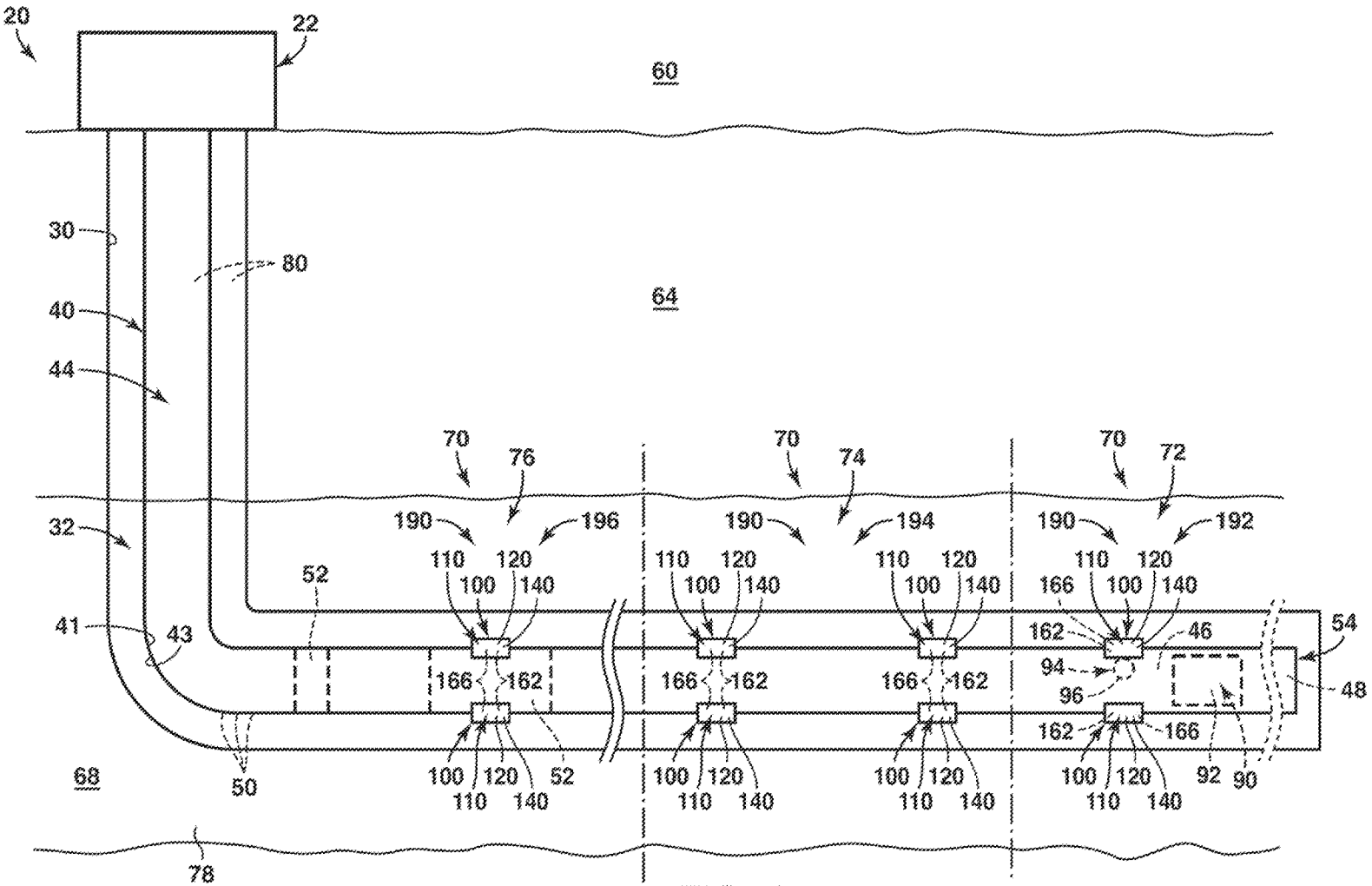
FIG. 1 is a schematic representation of illustrative, non-exclusive examples of a hydrocarbon well that may include and/or utilize the systems and methods according to the present disclosure.

FIG. 1 is a schematic representation of illustrative, non-exclusive examples of a hydrocarbon well 20 that may utilize and/or include the systems and methods according to the present disclosure. Hydrocarbon well 20 includes a wellbore 30 that extends between a surface region 60 and a subterranean formation 68 that is present in a subsurface region 64. Wellbore 30 includes a casing conduit 44 that extends within the wellbore. Casing conduit 44 may be defined by a casing string 40, which also may be referred to herein as a conduit body 40.

As illustrated in dashed lines in FIG. 1, casing conduit 44 may include, or may at least temporarily include, one or more fluid isolation devices 90, such as a plug 92, which may be configured to fluidly isolate an uphole portion 46 of casing conduit 44 from a downhole portion 48 of the casing conduit. In addition, at least a portion of hydrocarbon well 20 may include, contain, be operatively attached to, and/or be utilized with one or more wellbore flow-control assemblies 100 according to the present disclosure.

Wellbore flow-control assemblies 100 selectively provide fluid communication between casing conduit 44 and subterranean formation 68 therethrough. Wellbore flow-control assemblies 100 according to the present disclosure include and/or define a flow-controlled fluid conduit 110 that is separate, distinct, and/or different from casing conduit 44 and selectively conveys a fluid flow between subterranean formation 68 and casing conduit 44. Depending upon the particular embodiment, the fluid flow may include a fluid outflow from the casing conduit into the subterranean formation and/or a fluid inflow from the subterranean formation into the casing conduit.

Wellbore flow-control assemblies 100 further include a sacrificial flow-control device 140 that defines a first portion of the flow-controlled fluid conduit. The sacrificial flow-control device is adapted, configured, designed, and/or constructed to resist, block, and/or occlude the fluid flow through the flow-controlled fluid conduit prior to occurrence of a flow-initiation event (i.e., may be in a blocking configuration) and to permit, provide for, and/or allow the fluid flow through the flow-controlled fluid conduit subsequent to the flow-initiation event (i.e., may be in a flow configuration).

Illustrative, non-exclusive examples of sacrificial flow-control devices 140 according to the present disclosure include structures that are adapted, configured, and/or constructed to transition from the blocking configuration to the flow configuration a single time, structures that are configured to be at least partially destroyed upon transitioning from the blocking configuration to the flow configuration, and/or structures that include a sacrificial body that is configured to be separated, detached, and/or removed from a remainder of the sacrificial flow-control device upon transitioning from the blocking configuration to the flow configuration (such as subsequent to the flow-initiation event). Additional illustrative, non-exclusive examples of sacrificial flow-control devices 140 according to the present disclosure include burst disks, rupture disks, and/or shear disks.

In addition, wellbore flow-control assemblies 100 further include a directional flow-control device 120 that defines a second portion of the flow-controlled fluid conduit. The directional flow-control device is adapted, configured, designed, and/or constructed to permit one of the fluid outflow and the fluid inflow and to resist the other of the fluid outflow and the fluid inflow. Illustrative, non-exclusive examples of directional flow-control devices 120 according to the present disclosure include a ball and seat, a check valve, and/or a flapper.

Wellbore flow-control assemblies 100 may be included in, operatively attached to, and/or utilized with any suitable portion of well 20 and/or any suitable component thereof. As an illustrative, non-exclusive example, casing string 40 may include a plurality of casing segments 50, and one or more casing subs 52, which also may be referred to herein as stimulation subs 52 and/or production subs 52, and wellbore flow-control assemblies 100 may be operatively attached to and/or form a portion of casing segments 50 and/or casing subs 52.

As discussed in more detail herein, wellbore flow-control assemblies 100 according to the present disclosure may be utilized during any suitable operation and/or process that may be performed on and/or in well 20 and/or any suitable component thereof. As an illustrative, non-exclusive example, and subsequent to formation of wellbore 30 and insertion of casing string 40 therein, it may be desirable to circulate, remove, flush, and/or otherwise pump a first fluid from the wellbore, to replace the first fluid with a second fluid, to provide the second fluid to the subterranean formation, and/or to pump one or more structures into the wellbore. As illustrative, non-exclusive examples, this may include circulating a drilling fluid 80, such as a drilling mud, which may include sediment and/or particulate materials, from the wellbore, circulating a completion and/or breaker fluid into the subterranean formation, and/or to pumping a wiper plug to a terminal depth of the wellbore.

When sacrificial flow-control devices 140 are in the blocking configuration, casing strings 40 that include wellbore flow-control assemblies 100 according to the present disclosure and/or casing conduit 44 thereof may define a fluid-tight, or at least substantially fluid-tight, fluid conduit that extends between surface region 60 and a terminal end 54 of the casing string. As such, all, or at least a majority, of a fluid that may be provided to the casing conduit at and/or near surface region 60 (such as via a wellhead 22) may flow within casing conduit 44 to terminal end 54 before entering the subterranean formation. This may permit performing the above-described operations and/or processes efficiently and/or performing the above-described operations and/or processes without the need for installation of an inner string within casing conduit 44, which may decrease the time and/or costs associated therewith.

As an illustrative, non-exclusive example, the circulating may be accomplished by providing a circulating fluid from surface region 60 and/or wellhead 22 to one of casing conduit 44 and an annular space 32, which extends between casing string 40 and wellbore 30, flowing the circulating fluid to terminal end 54 of the casing conduit, and returning the circulating fluid to the surface region and/or the wellhead through the other of casing conduit 44 and annular space 32. As discussed, the drilling fluid may be circulated from wellbore 30 prior to occurrence of the flow-initiation event. Thus, a substantial portion, a majority, or all of the circulating fluid may be transferred between casing conduit 44 and annular space 32 at terminal end 54 and little and/or none of the circulating fluid may flow through wellbore flow-control assembly 100. It is within the scope of the present disclosure that, instead of circulating drilling fluid 80 from wellbore 30, the above-described procedure may be utilized to circulate a completion fluid and/or a breaker fluid into subterranean formation 68 via casing conduit 44 and/or to pump fluid isolation device 90 into casing conduit 44.

As another illustrative, non-exclusive example, it may be desirable to stimulate subterranean formation 68 by flowing a stimulant fluid through wellbore flow-control assembly 100 and into the subterranean formation. Under these conditions, flow-controlled fluid conduit 110 may define a stimulation flow path 162 that may convey the fluid outflow, and directional flow-control device 120 may be configured to permit the fluid outflow and resist the fluid inflow. In order to permit the stimulant fluid flow, sacrificial flow-control devices 140 that are associated with one or more wellbore flow-control assemblies 100 may be transitioned from the blocking configuration to the flow configuration, and stimulant fluid may be provided through flow-controlled fluid conduit(s) 110 of the transitioned wellbore flow-control assemblies 100 and into subterranean formation 68 to stimulate the subterranean formation.

It is within the scope of the present disclosure that all, or substantially all, sacrificial flow-control devices 140 that are associated with all, or substantially all, wellbore flow-control assemblies 100 present within well 20 may be transitioned from the blocking configuration to the flow configuration prior to stimulation of the subterranean formation. However, it is also within the scope of the present disclosure that, as indicated in dash-dot lines in FIG. 1, wellbore flow-control assemblies 100 may be arranged in a plurality of zones 190 of casing conduit 44 (with a first zone 192, a second zone 194, and a third zone 196 being illustrated therein), which may be configured to selectively transition from the blocking configuration to the flow configuration responsive to different flow-initiation events (such as a first flow-initiation event, a second flow-initiation event, and a third flow-initiation event, respectively). Similarly, subterranean formation 68 may include and/or define a plurality of regions 70 (with a first region 72, a second region 74, and a third region 76 being illustrated therein), which may be stimulated separately and/or independently from one another via wellbore flow-control assemblies that are associated with first zone 192, second zone 194, and/or third zone 196, respectively.

As an illustrative, non-exclusive example, and as discussed in more detail herein, sacrificial flow-control devices 140 that are associated with wellbore flow-control assemblies 100 that are present in first region 72 may be transitioned to the flow configuration independently from sacrificial flow-control devices 140 that are associated with second region 74 and/or third region 76. Subsequently, the stimulant fluid may be provided to the first region to stimulate the first region of the subterranean formation. After stimulation of first region 72, second region 74 and/or third region 76 may be stimulated in a similar manner. This process may be repeated any suitable number of times to stimulate any suitable number of regions 70 of the subterranean formation, such as at least 2, at least 4, at least 6, at least 8, at least 10, at least 15, at least 20, at least 25, at least 30, at least 40, or at least 50 regions of the subterranean formation.

As discussed in more detail herein, and subsequent to stimulation of a given region 70 of subterranean formation 68, a sealing device 94, such as a ball sealer 96, may be utilized to limit, or even prevent, fluid flow through wellbore flow-control assemblies 100 that are associated with the given region 70 prior to stimulation of a subsequent region 70 of the subterranean formation. This may focus and/or limit stimulant fluid flow to specific, or target, regions 70 of subterranean formation 68, thereby improving an overall efficiency of the stimulation operation.

As yet another illustrative, non-exclusive example, it also may be desirable to produce a reservoir fluid 78 from subterranean formation 68 by flowing the reservoir fluid from the subterranean formation, through wellbore flow-control assemblies 100, and into casing conduit 44 as the fluid inflow. Under these conditions, at least a portion of flow-controlled fluid conduit 110 may define a portion of a production flow path 166 and may convey the fluid inflow. As an illustrative, non-exclusive example, and when wellbore flow-control assembly 100 is utilized to stimulate subterranean formation 68 along stimulation flow path 162 prior to production of reservoir fluid 78, production flow path 166 may be defined by sacrificial flow-control device 140 but not by directional flow-control device 120. As another illustrative, non-exclusive example, and when the subterranean formation is not stimulated through wellbore flow-control assemblies 100, production flow path 166 may include both sacrificial flow-control device 140 and directional flow-control device 120, with directional flow-control device 120 being configured to provide for the fluid inflow while restricting the fluid outflow. Under these conditions, directional flow-control device 120 and/or wellbore flow-control assembly 100 also may be referred to herein as an inflow-control device.

FIGS. 2-12 provide additional illustrative, non-exclusive examples of wellbore flow-control assemblies 100 according to the present disclosure. It is within the scope of the present disclosure that any of the wellbore flow-control assemblies 100 of any of FIGS. 2-12 may be included and/or utilized in the hydrocarbon well 20 of FIG. 1. Similarly, any of the components and/or features illustrated in and/or discussed herein with reference to any one of FIGS. 2-12 may be utilized with any other of FIGS. 2-12 without departing from the scope of the present disclosure.

Figure 2:
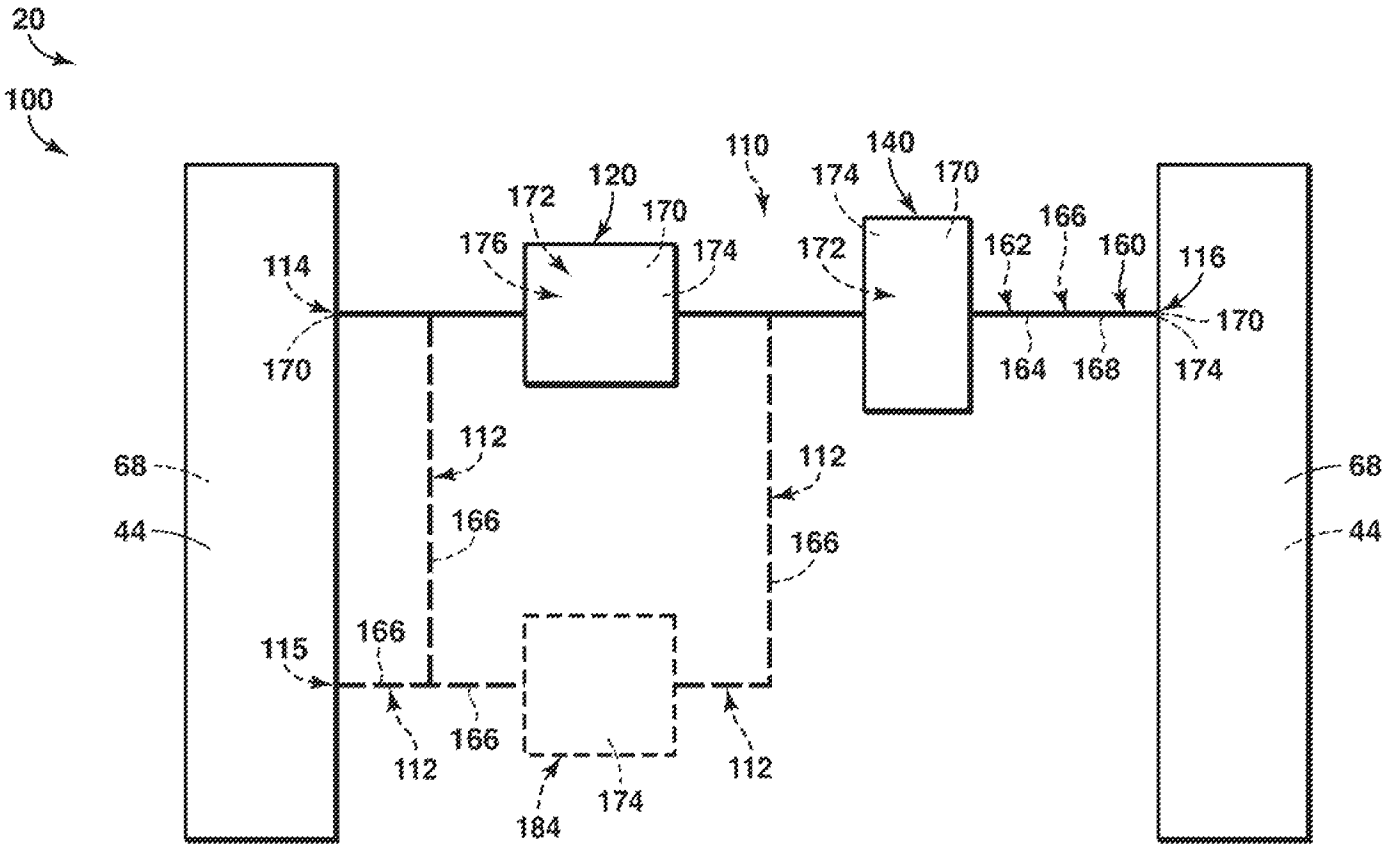
FIG. 2 is a schematic representation of illustrative, non-exclusive examples of a wellbore flow-control assembly according to the present disclosure.

FIG. 2 is a schematic representation of an illustrative, non-exclusive example of a wellbore flow-control assembly 100 according to the present disclosure. Wellbore flow-control assembly 100 defines a flow-controlled fluid conduit 110 that conveys a fluid flow 160, such as a fluid outflow 164 and/or a fluid inflow 168, between a casing conduit 44 and a subterranean formation 68.

As illustrated in solid lines in FIG. 2, wellbore flow-control assembly 100 includes a sacrificial flow-control device 140 that defines a first portion of flow-controlled fluid conduit 110 and a directional flow-control device 120 that defines a second portion of the flow-controlled fluid conduit. It is within the scope of the present disclosure that sacrificial flow-control device 140 and directional flow-control device 120 may define any suitable relative orientation within wellbore flow-control assembly 100. As an illustrative, non-exclusive example, and as illustrated in solid lines in FIG. 1, directional flow-control device 120 may be located between casing conduit 44 and sacrificial flow-control device 140 along flow-controlled fluid conduit 110. As another illustrative, non-exclusive example, and as indicated in dashed lines in FIG. 1, the relative orientation of casing conduit 44 and subterranean formation 68 may be reversed without departing from the scope of the present disclosure.

As also illustrated in dashed lines in FIG. 2, wellbore flow-control assemblies 100 according to the present disclosure further may include additional structures, such as a flow restrictor 184 and/or one or more bypass conduits 112, which may be configured to bypass at least a portion of flow-controlled fluid conduit 110. In addition, and as discussed in more detail herein, a single wellbore flow-control assembly 100 may include and/or define any suitable number of openings 114, 115 into casing conduit 44, which also may be referred to herein as internal openings 114, 115, and/or an opening 116 into subterranean formation 68, which also may be referred to herein as an external opening 116.

As an illustrative, non-exclusive example, flow-controlled fluid conduit 110 may define a stimulation flow path 162 that conveys fluid outflow 164 from casing conduit 44 to subterranean formation 68. Stimulation flow path 162 further may include a stimulation orifice 170, which may be associated with any suitable portion of flow-controlled fluid conduit 110, such as directional flow-control device 120, sacrificial flow-control device 140, internal opening 114, 115, and/or external opening 116, and may control a flow rate and/or a velocity of a stimulant fluid flow therethrough.

As shown in solid lines in FIG. 2, stimulation flow path 162 may include the entire flow-controlled fluid conduit 110. In such an embodiment, directional flow-control device 120 may be configured to provide for fluid outflow 164 and to resist fluid inflow 168, thereby permitting the stimulant fluid flow. In addition, directional flow-control device 120 and/or sacrificial flow-control device 140 further may include and/or define a stimulation port 172, which may include and/or define stimulation orifice 170. Stimulation orifice 170 may include and/or define any suitable stimulation orifice characteristic dimension, such as a characteristic stimulation orifice diameter. As illustrative, non-exclusive examples, the stimulation orifice characteristic dimension may be at least 6 millimeters (mm), at least 8 mm, at least 10 mm, at least 12 mm, at least 14 mm, at least 16 mm, at least 18 mm, at least 20 mm, at least 22 mm, or at least 24 mm. As another illustrative, non-exclusive example, the stimulation orifice characteristic dimension may be less than 40 mm, less than 38 mm, less than 36 mm, less than 34 mm, less than 32 mm, less than 30 mm, less than 28 mm, less than 26 mm, less than 24 mm, less than 22 mm, less than 20 mm, less than 18 mm, or less than 16 mm.

As used herein, the phrase "characteristic dimension" may refer to any suitable average, representative, and/or effective dimension. Thus, the characteristic dimension may, additionally or alternatively, be referred to herein as a diameter, an effective diameter, a characteristic diameter, an extent, a maximum extent, and/or a minimum extent.

As an illustrative, non-exclusive example, and when stimulation orifice 170 is a circular stimulation orifice, the stimulation orifice characteristic dimension may be defined by the diameter of the circular stimulation orifice. As another illustrative, non-exclusive example, and when stimulation orifice 170 is not a circular stimulation orifice, the stimulation orifice characteristic dimension may be defined by a maximum extent of the stimulation orifice, a minimum extent of the stimulation orifice, and/or by a diameter of a circle that defines a cross-sectional area that is the same as that of the stimulation orifice (i.e., an effective diameter of the stimulation orifice).

As another illustrative, non-exclusive example, flow-controlled fluid conduit 110 may define at least a portion of a production flow path 166 that conveys fluid inflow 168 from subterranean formation 68 and into casing conduit 44. Production flow path 166 may include and/or be defined, at least in part, by a production orifice 174 that is configured and/or sized to control a flow rate and/or velocity of the fluid inflow. The production orifice may be located in any suitable portion of flow-controlled fluid conduit 110, such as directional flow-control device 120, sacrificial flow-control device 140, flow restrictor 184, internal opening 114, 115, and/or external opening 116.

Production orifice 174 may include and/or define any suitable production orifice characteristic dimension, such as a diameter of the production orifice. As illustrative, non-exclusive examples, the production orifice characteristic dimension may be at least 1 millimeter (mm), at least 1.5 mm, at least 2 mm, at least 2.5 mm, at least 3 mm, or at least 3.5 mm. As additional illustrative, non-exclusive examples, production orifice characteristic dimensions may be less than 6 mm, less than 5.5 mm, less than 5 mm, less than 4.5 mm, less than 4 mm, less than 2.5 mm, or less than 3 mm.

It is within the scope of the present disclosure that production flow path 166 may include the entire flow-controlled fluid conduit 110 and that directional flow-control device 120 may be configured to permit fluid inflow 168 and resist fluid outflow 164. Under these conditions, directional flow-control device 120 may include and/or may be referred to as an inflow control device 176, such as a check valve, which may include and/or define production orifice 174.

It is also within the scope of the present disclosure that production flow path 166 may include a portion of, or less than the entire, flow-controlled fluid conduit 110. As an illustrative, non-exclusive example, production flow path 166 may not include directional flow-control device 120. When the production flow path does not include the entire flow-controlled fluid conduit 110, the production flow path may bypass a portion of the flow-controlled fluid conduit, such as directional flow-control device 120, using one or more bypass conduits 112.

It is within the scope of the present disclosure that wellbore flow-control assembly 100 may define both stimulation flow path 162 and production flow path 166. When wellbore flow-control assembly 100 defines both the stimulation flow path and the production flow path, the stimulation flow path may be at least partially coextensive with, but different from, the production flow path. Thus, a portion of flow-controlled fluid conduit 110, such as sacrificial flow-control device 140, may define at least a portion of both stimulation flow path 162 and production flow path 166 even though the stimulation flow path and the production flow path are not both defined entirely by the flow-controlled fluid conduit and/or are not entirely coextensive.

As an illustrative, non-exclusive example, the stimulation flow path may include a first portion of the flow-controlled fluid conduit, the production flow path may include a second portion of the flow-controlled fluid conduit, and the first portion of the flow-controlled fluid conduit may be at least partially overlapping with but different from the second portion of the flow-controlled fluid conduit. As another illustrative, non-exclusive example, the first portion of the flow-controlled fluid conduit may include directional flow-control device 120, and the second portion of the flow-controlled fluid conduit may not include directional flow-control device 120, such as through the use of one or more bypass conduits 112, as discussed in more detail herein. As yet another illustrative, non-exclusive example, the second portion of the flow-controlled fluid conduit may include bypass conduits 112 and flow restrictor 184, and the first portion of the flow-controlled fluid conduit may not include bypass conduits 112 and/or flow restrictor 184.

As illustrated in FIG. 2, bypass conduits 112 may route production flow path 166 through flow restrictor 184, which may include production orifice 174 and/or inflow control device 176, to control a flow rate and/or direction of fluid inflow 168. In addition, and as also illustrated in FIG. 2, bypass conduits 112 may be configured to provide fluid inflow 168 to casing conduit 44 via internal opening 114, which may be shared with flow-controlled fluid conduit 110, and/or through a separate internal opening 115.

As an illustrative, non-exclusive example, the production flow path may enter wellbore flow-control assembly 100 at external opening 116 and may include sacrificial flow-control device 140. However, bypass conduit 112 may bypass directional flow-control device 120, thereby providing for fluid inflow 168 along production flow path 166 even when directional flow-control device 120 is configured to resist the fluid inflow.

FIG. 2 illustrates wellbore flow-control assembly 100 as defining at least a first internal opening 114 and optionally defining a second internal opening 115; however, it is within the scope of the present disclosure that wellbore flow-control assembly 100 may define any suitable number of internal openings, such as more than two internal openings. In addition, internal openings 114, 115 may include any suitable structure. As an illustrative, non-exclusive example, the internal openings may be defined by an internal surface 41 of casing string 40 (as illustrated in FIG. 1) and may provide fluid communication between casing conduit 44 and flow-controlled fluid conduit 110.

Internal openings 114, 115 further may include and/or be defined by a portion of directional flow-control device 120 and/or sacrificial flow-control device 140. When internal openings 114, 115 are defined by a portion of sacrificial flow-control device 140, it is within the scope of the present disclosure that the internal openings may not be present (or otherwise available for fluid flow therethrough) when the sacrificial flow-control device is in the blocking configuration but may be defined by the sacrificial flow-control device after the sacrificial flow-control device transitions to the flow configuration (such as subsequent to the flow-initiation event).

When wellbore flow-control assembly 100 includes a plurality of internal openings, such as internal openings 114 and 115, the internal openings may be associated with and/or define a portion of different flow paths within the wellbore flow-control assembly. As an illustrative, non-exclusive example, a first internal opening, such as internal opening 114, may be associated with a first flow path, such as stimulation flow path 162, and also may be referred to herein as an internal stimulation opening 114. In addition, a second internal opening, such as internal opening 115, may be associated with a second flow path, such as production flow path 166, and also may be referred to herein as an internal production opening 115.

FIG. 2 also illustrates wellbore flow-control assembly 100 as defining a single external opening 116; however, it is within the scope of the present disclosure that wellbore flow-control assembly 100 may define any suitable number of external openings, such as two or more than two external openings. In addition, external opening 116 may include any suitable structure. As an illustrative, non-exclusive example, the external opening may be defined by an external surface 43 of casing string 40 (as illustrated in FIG. 1) and may provide fluid communication between subterranean formation 68 and flow-controlled fluid conduit 110.

Similar to internal openings 114, 115, external opening 116 also may include and/or be defined by a portion of directional flow-control device 120 and/or sacrificial flow-control device 140. When external opening 116 is defined by a portion of sacrificial flow-control device 140, it is within the scope of the present disclosure that the external opening may not be present (or otherwise available for fluid flow therethrough) when the sacrificial flow-control device is in the blocking configuration but may be defined by the sacrificial flow-control device after the sacrificial flow-control device transitions to the flow configuration (such as subsequent to the flow-initiation event).

As used herein, the phrase "flow-initiation event" may include any suitable event, condition, and/or phenomenon that may occur and/or be generated within hydrocarbon well 20, and/or any suitable component thereof, and that may transition one or more sacrificial flow-control devices 140 from the blocking configuration to the flow configuration. As an illustrative, non-exclusive example, the flow-initiation event may include, or be associated with, generating a pressure differential between the casing conduit and the subterranean formation that is greater than a threshold pressure differential (i.e., a condition in which a pressure within casing conduit 44 and in the vicinity of sacrificial flow-control device 140 is greater than a pressure within subterranean formation 68 and in the vicinity of the sacrificial flow-control device by at least a threshold magnitude). This threshold pressure differential also may be referred to herein as a threshold positive pressure differential.

As another illustrative, non-exclusive example, the flow-initiation event may be followed by a release event. As discussed in more detail herein, the release event may include decreasing the pressure differential between the casing conduit and the subterranean formation such that it is less than a threshold negative pressure differential (i.e., a condition in which the pressure within casing conduit 44 and in the vicinity of the sacrificial flow-control device is less than the pressure within subterranean formation 68 and in the vicinity of the sacrificial flow-control device by at least a threshold magnitude).

As discussed in more detail herein with reference to FIGS. 3-12, sacrificial flow-control device 140 may include a sacrificial body 144 that is configured to prevent fluid flow through the sacrificial flow-control device when the sacrificial flow-control device is in the blocking configuration and may be removed from the sacrificial flow-control device when the sacrificial flow-control device is in the flow configuration, thereby permitting fluid flow therethrough. Under these conditions, the threshold positive pressure differential may include a pressure differential that is sufficient in magnitude to separate and/or dislodge the sacrificial body from a sealing configuration within the sacrificial flow-control device and also may be referred to herein as a rupture pressure.

It is within the scope of the present disclosure that, as discussed in more detail herein with reference to FIGS. 9-12, the sacrificial body may be removed from the sacrificial flow-control device subsequent and/or directly responsive to the flow-initiation event. However, and as illustrated in FIGS. 3-7, it is also within the scope of the present disclosure that a retaining collar 148 may retain the sacrificial body within the sacrificial flow-control device subsequent to the flow-initiation event and prior to the release event, with the release event providing a motive force to remove the sacrificial body from the sacrificial flow-control device. As an illustrative, non-exclusive example, the release event may include generating a threshold negative pressure differential that is large enough in magnitude to push, flow, and/or otherwise convey the sacrificial body from the sacrificial flow-control device and into the casing conduit.

FIGS. 3-7 provide less schematic but still illustrative, non-exclusive examples of wellbore flow-control assemblies 100 according to the present disclosure that may include and/or be an inflow control device 176 that defines a production flow path 104 and/or an outflow control device 180 that defines a stimulation flow path 108. In FIGS. 3-7, like numbers denote like structures, and each illustrated structure may not be labeled in each of FIGS. 3-7.

The wellbore flow-control assemblies of FIGS. 3-7 may form a portion of a casing string 40, and/or a casing sub 52 thereof, that may be present in a hydrocarbon well 20. Wellbore flow-control assemblies 100 include a flow-controlled fluid conduit 110 that extends and selectively conveys a fluid flow between a casing conduit 44 and a subterranean formation 68, with an internal opening 114 providing fluid communication between the flow-controlled fluid conduit and the casing conduit, and an external opening 116 providing fluid communication between the flow-controlled fluid conduit and the subterranean formation.

Figure 3:
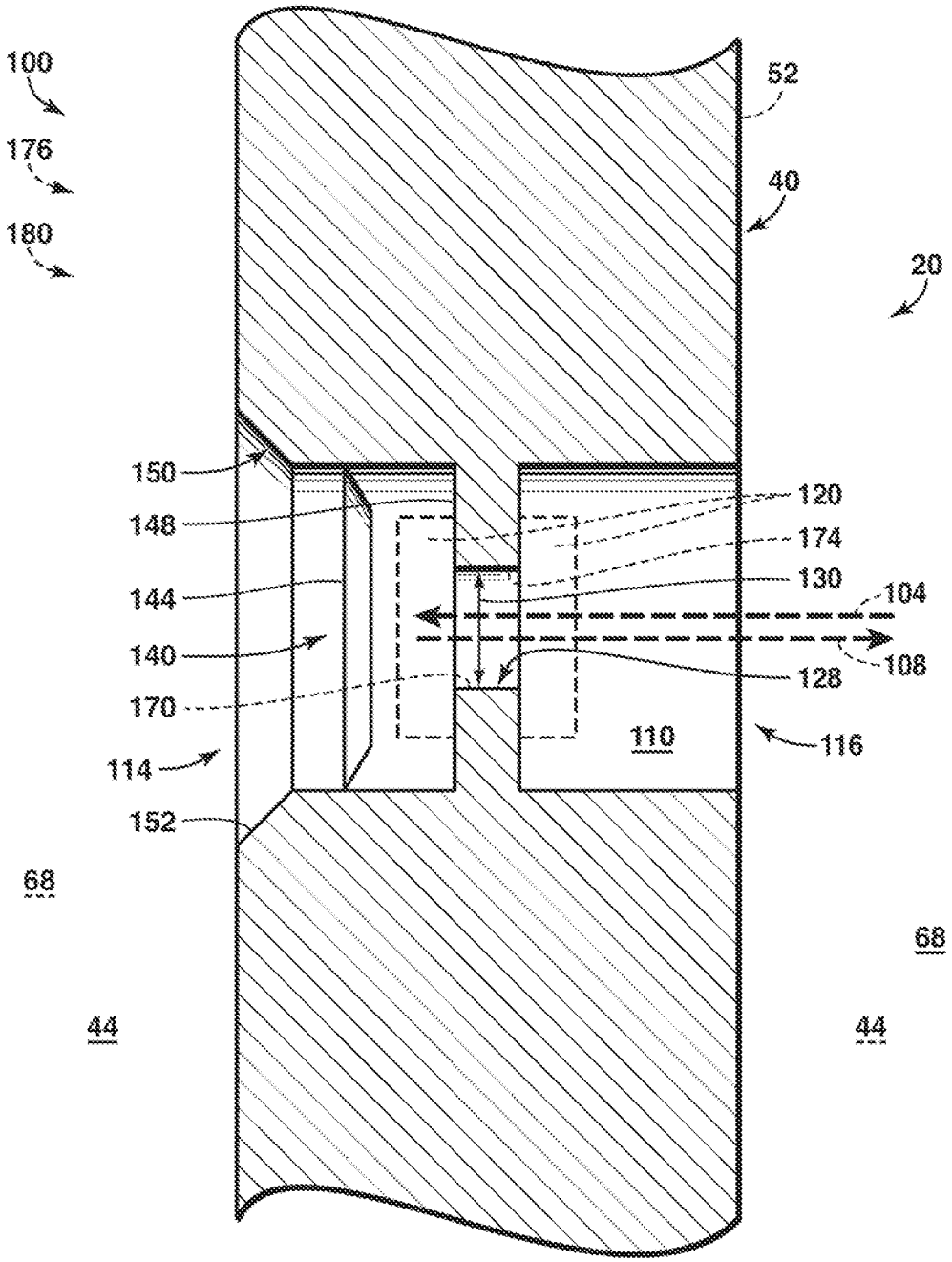
FIG. 3 provides less schematic but still illustrative, non-exclusive examples of a wellbore flow-control assembly according to the present disclosure.
Figure 4:
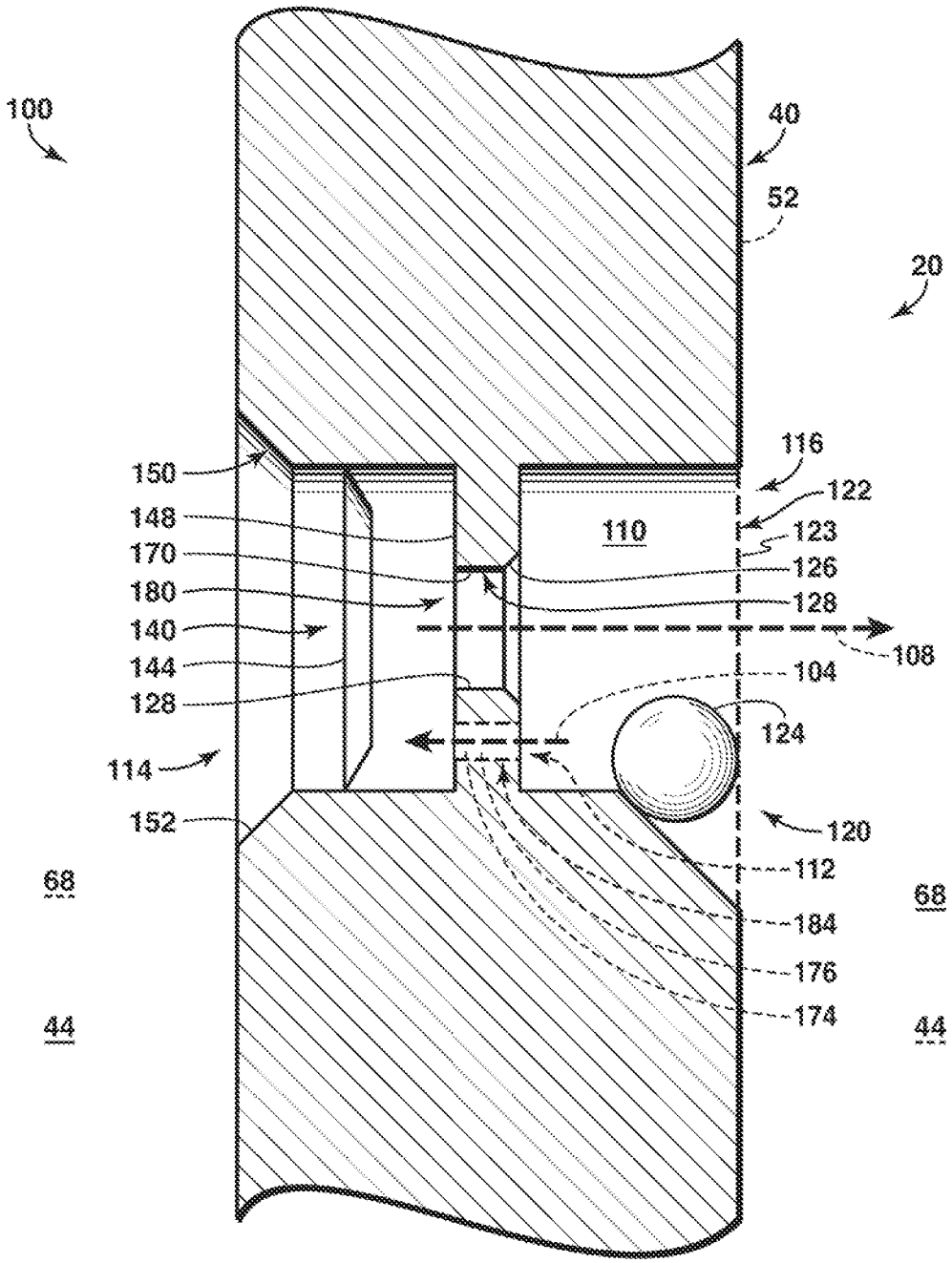
FIG. 4 provides additional less schematic but still illustrative, non-exclusive examples of a wellbore flow-control assembly according to the present disclosure in the blocking configuration.

As indicated in dashed lines in FIGS. 3-4, and similar to the more schematically illustrated wellbore flow-control assembly of FIG. 2, an orientation of components within wellbore flow-control assembly 100 relative to casing conduit 44 and/or subterranean formation 68 may be reversed without departing from the scope of the present disclosure.

The wellbore flow-control assemblies of FIGS. 3-7 include a sacrificial flow-control device 140, illustrative, non-exclusive examples of which are discussed in more detail herein, that includes a sacrificial body 144, such as a sealing disk, that blocks fluid flow through the sacrificial flow-control device prior to the flow-initiation event, and which is removed from the sacrificial flow-control device subsequent to the flow-initiation event, thereby permitting the fluid flow therethrough. Wellbore flow-control assembly 100 further includes a retaining collar 148, which also may be referred to herein as a shoulder 148, that may define an orifice 128. Orifice 128 may define a characteristic dimension 130 (as illustrated in FIG. 3), such as a characteristic diameter, illustrative, non-exclusive examples of which are discussed in more detail herein.

Figure 6:
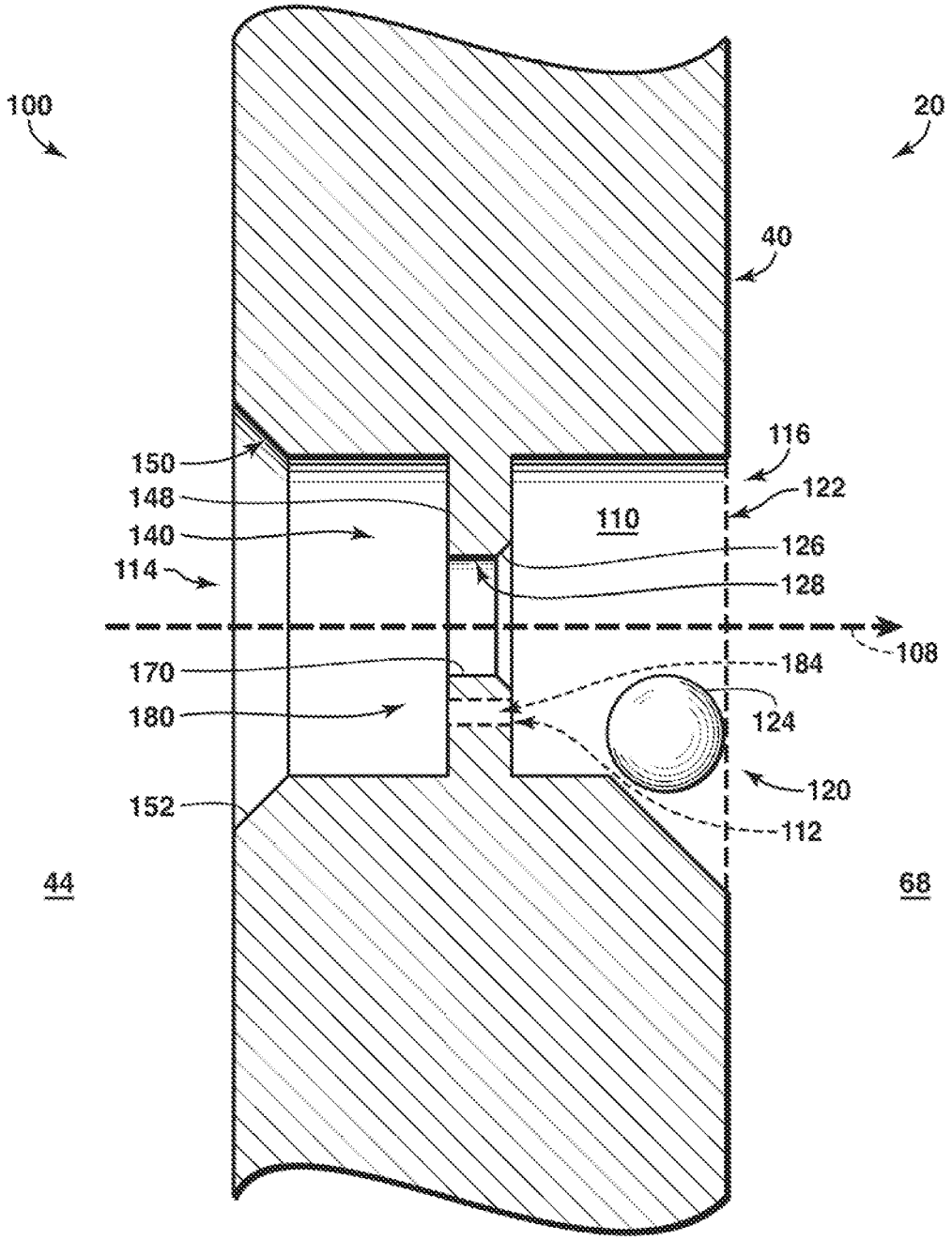
FIG. 6 provides illustrative, non-exclusive examples of the wellbore flow-control assembly of FIGS. 4-5, wherein the sacrificial body has been removed from the wellbore flow-control assembly and a stimulant fluid is being supplied to a subterranean formation along a stimulation flow path.
Figure 7:
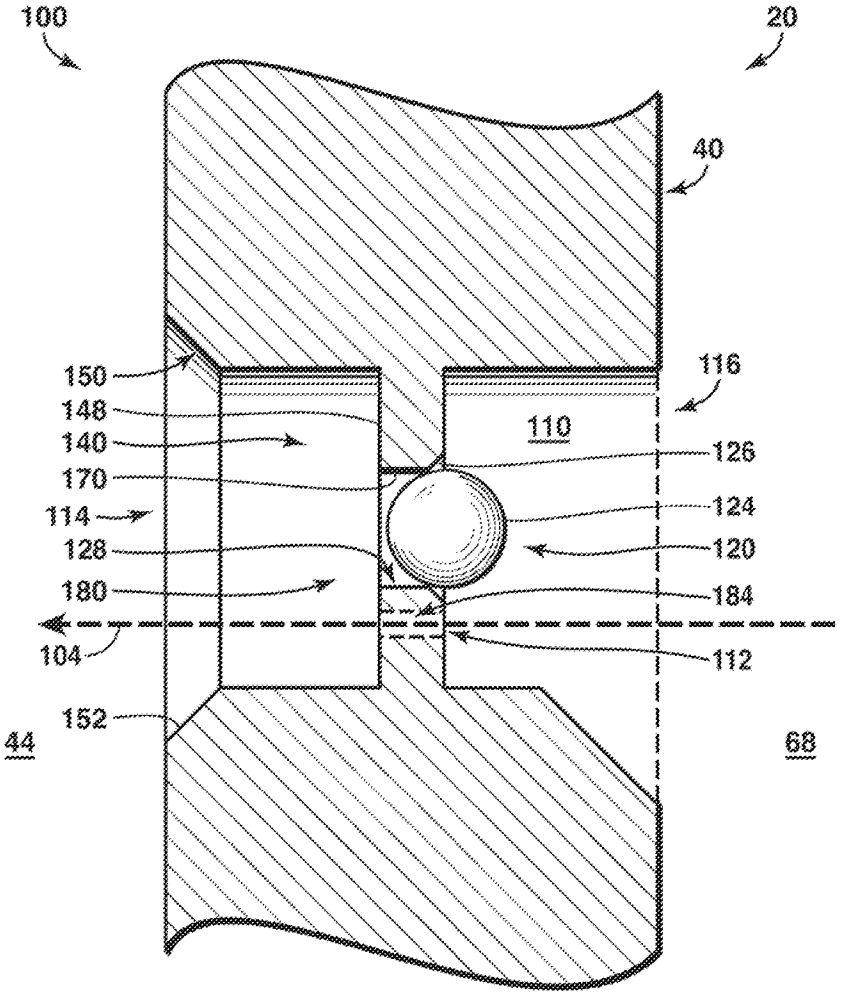
FIG. 7 provides an illustrative, non-exclusive example of the wellbore flow-control assembly of FIGS. 4-6, wherein the sacrificial body has been removed from the wellbore flow-control assembly and a reservoir fluid is being received into a casing conduit along a production flow path.

Prior to the flow-initiation event, sacrificial body 144 may be operatively attached to, form a portion of, and/or form a fluid seal with wellbore flow-control assembly 100, as illustrated in FIGS. 3-4. However, the flow-initiation event may detach, remove, and/or otherwise separate sacrificial body 144 from the wellbore flow-control assembly, as illustrated in FIGS. 5-7.

Figure 5:
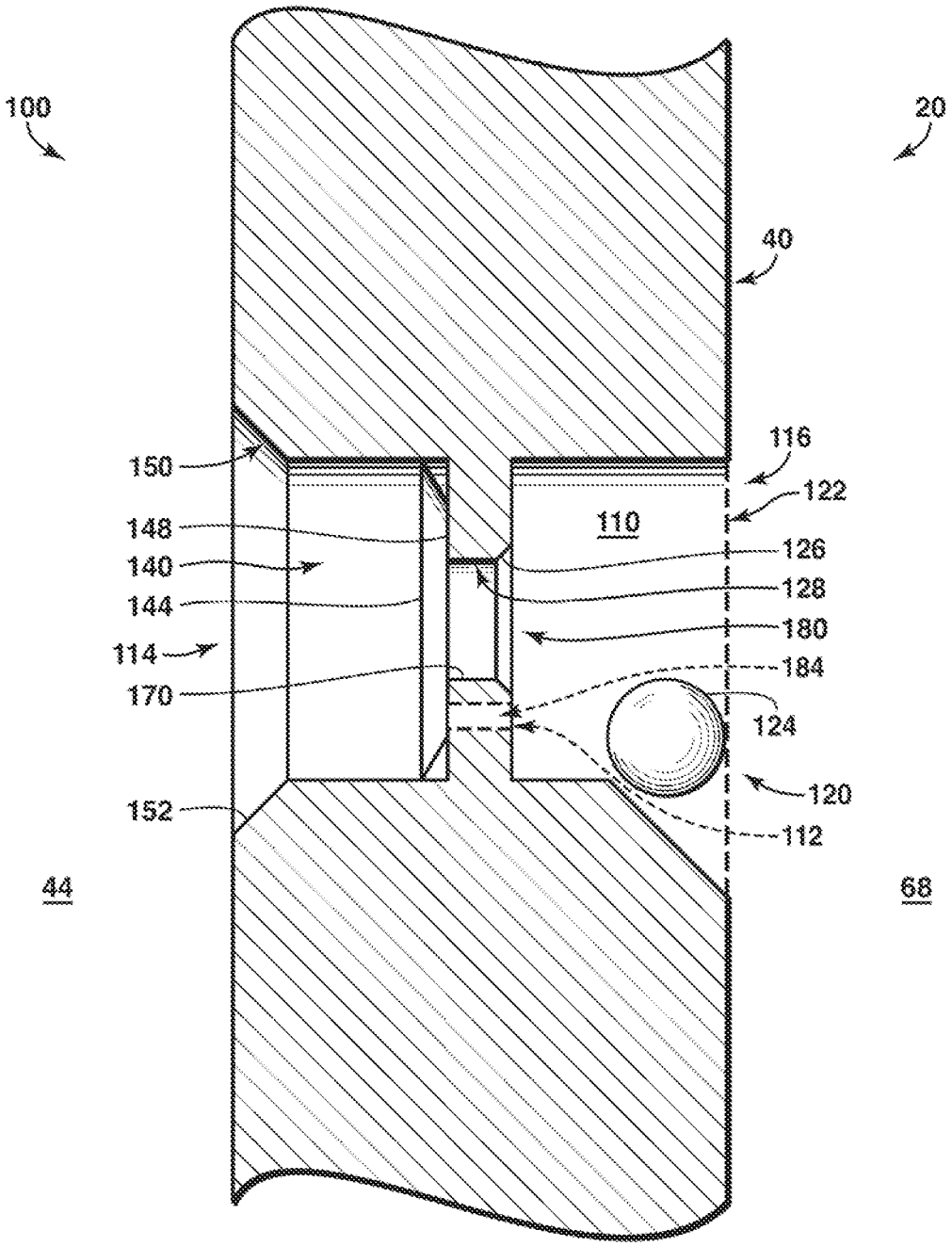
FIG. 5 provides illustrative, non-exclusive examples of the wellbore flow-control assembly of FIG. 4, wherein a sacrificial body has been separated from an initial position within the wellbore flow-control assembly.

Retaining collar 148 may be sized to retain sacrificial body 144 within wellbore flow-control assembly 100 subsequent to the flow-initiation event, as illustrated in FIG. 5. Retaining collar 148 may provide a mechanism by which a plurality of wellbore flow-control assemblies may be transitioned from the blocking configuration to the flow configuration even if the individual wellbore flow-control assemblies that comprise the plurality of wellbore flow-control assemblies transition from the blocking configuration to the flow configuration under slightly different, or different, conditions. As an illustrative, non-exclusive example, and as discussed in more detail herein, the flow-initiation event may include generating a pressure differential between the casing conduit and the subterranean formation that is greater than a threshold positive pressure differential. This generating portion of the flow-initiation event may be followed by a release event that includes generating a pressure differential between the casing conduit and the subterranean formation that is less than a threshold negative pressure differential.

Under these conditions, the flow-initiation event may separate sacrificial body 144 from a remainder of the wellbore flow-control assembly and may provide a motive force to press the sacrificial body against retaining collar 148, as illustrated in FIG. 5. This force may generate an at least partial fluid seal between the sacrificial body and the retaining collar and limit fluid flow through orifice 128 and/or bypass conduit 112. The wellbore flow-control assembly may be maintained in this configuration until the release event (i.e., generation of a pressure differential that is less than the threshold negative pressure differential). The release event may provide a motive force for removing the sacrificial body from the wellbore flow-control assembly, as illustrated in FIGS. 6-7.

Internal opening 114 may include any suitable structure, illustrative, non-exclusive examples of which are discussed in more detail herein. In addition, and as illustrated in FIGS. 3-7, the internal opening may define a sealing surface 150, such as a ball seat 152, that may be configured, sized, and/or designed to at least temporarily receive a sealing device 94, such as a ball sealer 96 (as illustrated in FIG. 1). The presence of sealing device 94 on sealing surface 150 may limit, restrict, and/or occlude fluid flow through wellbore flow-control assembly 100.

When internal opening 114 defines ball seat 152, the ball seat may be a machined ball seat 152 that is formed prior to insertion of wellbore flow-control assembly 100 into hydrocarbon well 20. Thus, a uniformity of a size, shape, and/or orientation of a sealing region that is defined between ball seat 152 and ball sealer 96 may be significantly greater than a uniformity of a more traditional sealing region that may be formed between a ball sealer and a perforation that may be formed in the casing string with a perforation gun. This increased uniformity may improve an integrity of a seal that is formed between the ball sealer and the ball seat relative to the traditional sealing region, thereby increasing an overall efficiency of the sealing therebetween.

As also illustrated in FIGS. 3-7, wellbore flow-control assembly 100 further may include a directional flow-control device 120, illustrative, non-exclusive examples of which are discussed in more detail herein. In FIG. 3, the directional flow-control device is schematically illustrated in dashed lines to indicate that the directional flow-control assembly is optional and may include any suitable directional flow-control device that may be located in any suitable portion of the wellbore flow-control assembly.

The directional flow-control device of FIG. 3 may permit fluid inflow from subterranean formation 68 into casing conduit 44, thereby defining production flow path 104, and wellbore flow-control assembly 100 may be referred to herein as including and/or being inflow control device 176. Under these conditions, orifice 128 may be a production orifice 174 and may be sized to control the fluid inflow, as discussed in more detail herein.

Alternatively, the directional flow-control device of FIG. 3 may permit fluid outflow from casing conduit 44 into subterranean formation 68, thereby defining stimulation flow path 108, and wellbore flow-control assembly 100 may be referred to herein as including and/or being outflow-control device 180. Under these conditions, orifice 128 may be a stimulation orifice 170 and may be sized to control the fluid outflow, as discussed in more detail herein.

In FIGS. 4-7, directional flow-control device 120 is less schematically illustrated as including a ball 124 and seat 126. Ball 124 may be sized to seal with seat 126, thereby limiting, blocking, and/or occluding fluid inflow from subterranean formation 68 and into casing conduit 44 but permitting fluid outflow from the casing conduit and into the subterranean formation. Thus, orifice 128 may be a stimulation orifice 170 and may define a portion of stimulation flow path 108. When directional flow-control device 120 includes ball 124 and seat 126, wellbore flow-control assembly 100 further may include one or more retaining structures 122, such as a screen 123, that may retain ball 124 within the wellbore flow-control assembly while simultaneously providing for the fluid outflow and/or the fluid inflow.

As illustrated in dashed lines in FIGS. 4-7, wellbore flow-control assembly 100 further may include and/or define a bypass conduit 112 that is separate from stimulation orifice 170, bypasses directional flow-control device 120, and defines a portion of production flow path 104. Bypass conduit 112 may be associated with, may include, and/or may be any suitable flow-restrictor 184, such as inflow control device 176 and/or production orifice 174, that may control and/or limit the fluid outflow but permit the fluid inflow therethrough.

In FIG. 4, and prior to the flow-initiation event, sacrificial body 144 may be operatively attached to sacrificial flow-control device 140 and may block, limit, restrict, and/or occlude fluid flow therethrough. As illustrated in FIG. 5, and subsequent to the flow-initiation event, sacrificial body 144 may be separated from an initial position with the sacrificial flow-control device and may be pressed against retaining collar 148. In this configuration, the sacrificial body may form an at least partial seal with retaining collar 148 and may at least partially block fluid flow through orifice 128 and/or bypass conduit 112. The sacrificial body may be maintained in contact with retaining collar 148 by a positive pressure differential between casing conduit 44 and subterranean formation 68 (such as a positive pressure differential that may be generated during the flow-initiation event). As discussed in more detail herein, retaining collar 148 and the sealing between the retaining collar and sacrificial body 144 may permit transitioning a plurality of wellbore flow-control assemblies 100 that may be associated with casing string 40 from the blocking configuration to the flow configuration even if a portion of the plurality of wellbore flow-control assemblies transitions from the blocking configuration to the flow configuration at a different magnitude of the flow-initiation event than a remainder of the wellbore flow-control assemblies. Subsequent to the flow-initiation event, and as illustrated in FIGS. 6-7, a release event may remove sacrificial body 144 from sacrificial flow-control device 140, thereby permitting fluid flow therethrough.

Subsequent to removal of sacrificial body 144 from the wellbore flow-control assembly, a stimulant fluid flow may be provided from wellbore conduit 44 and to subterranean formation 68 along stimulation flow path 108 that includes stimulation orifice 170, as illustrated in FIG. 6. Stimulation orifice 170 may be sized for the stimulant fluid flow and may be larger than a desired production orifice size, may permit fluid inflows that are larger than desired, and/or may not maintain a desired pressure differential between casing conduit 44 and subterranean formation 68 during production of a reservoir fluid from the subterranean formation if the fluid inflow were to flow therethrough.

Thus, and when a pressure within the subterranean formation is greater than a pressure within the wellbore conduit (i.e., under conditions in which production of the reservoir fluid may occur), ball 124 and seat 126 may seal stimulation orifice 170, thereby blocking, resisting, and/or occluding fluid inflow therethrough, as illustrated in FIG. 7. However, and as discussed, production orifice 174 may be sized to permit the desired fluid inflow and/or to maintain the desired pressure differential during production of reservoir fluid from subterranean formation 68. Thus, the wellbore flow-control assembly of FIGS. 4-7 may permit controlled stimulation of, and production from, the subterranean formation on separate production and stimulation flow paths that are at least partially coextensive along a portion of a length of flow-controlled fluid conduit 110.

While the above discussion describes stimulation of the subterranean formation along stimulation flow path 108 (as illustrated in FIG. 6) and subsequent production from the subterranean formation along production flow path 104 (as illustrated in FIG. 7), it is within the scope of the present disclosure that the stimulating and/or the producing may occur in any suitable order. As illustrative, non-exclusive examples, this may include stimulating prior to the producing, producing prior to the stimulating, and/or repeatedly and/or cyclically stimulating and/or producing.

Figure 8:
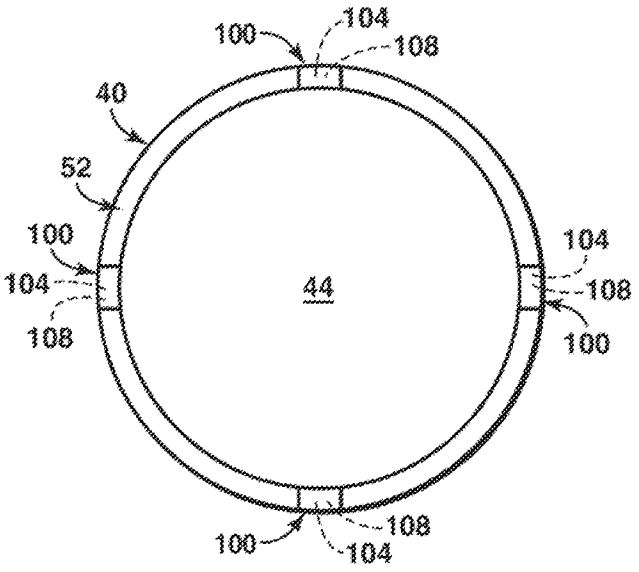
FIG. 8 provides illustrative, non-exclusive examples of a schematic cross-sectional view of a casing sub that may include a plurality of wellbore flow-control assemblies according to the present disclosure.

FIG. 8 provides a schematic cross-sectional view of casing subs 52 that may include a plurality of wellbore flow-control assemblies 100 according to the present disclosure. Casing subs 52 may form a portion of casing string 40 and may define a portion of casing conduit 44. FIG. 8 illustrates casing sub 52 as including four wellbore flow-control assemblies 100 that are equally spaced around a circumference of the casing sub. However, it is within the scope of the present disclosure that casing sub 52 may include any suitable number of wellbore flow-control assemblies 100, such as one, two, three, four, five, six, eight, ten, or more than ten wellbore flow-control assemblies, that may be arranged with any suitable relative (uniform or non-uniform) spacing and/or orientation. FIG. 8 also illustrates that each wellbore flow-control assembly 100 of casing sub 52 may define a production flow path 104, a stimulation flow path 108, and/or both production flow path 104 and stimulation flow path 108.

FIGS. 9-12 provide less schematic but still illustrative, non-exclusive examples of a partial longitudinal cross-sectional view of a casing string 40 and/or casing sub 52 that includes two wellbore flow-control assemblies 100 according to the present disclosure in the form of first wellbore flow-control assembly 101 and second wellbore flow-control assembly 102. First wellbore flow-control assembly 101 and second wellbore flow-control assembly 102 may be present in, associated with, and/or in fluid communication with two different regions 70 of subterranean formation 68, such as first region 72 and second region 74, respectively, and are configured to selectively provide fluid communication between casing conduit 44 and the subterranean formation.

In FIGS. 9-12 wellbore flow-control assemblies 100 include a directional flow-control device 120 that includes a ball 124 and seat 126, with a retaining structure 122, such as a screen 123, retaining ball 124 within the wellbore flow-control assemblies. The wellbore flow-control assemblies of FIGS. 9-12 further include a sacrificial flow-control device 140, illustrative, non-exclusive examples of which are discussed in more detail herein, that includes a sacrificial body 144 that is configured to separate from the sacrificial flow-control device responsive to a flow-initiation event. The wellbore flow-control assemblies further include an external opening 116, which may be defined by sacrificial flow-control device 140 subsequent to the flow-initiation event, and two internal openings 114 and 115, which also may be referred to herein as internal production opening 165 and internal stimulation opening 161, respectively.

As illustrated in FIGS. 9-12, a production orifice 174 may be contained within wellbore flow-control assembly 100. Production orifice 174 may provide fluid communication between internal production opening 165 and internal stimulation opening 161.

Figure 9:
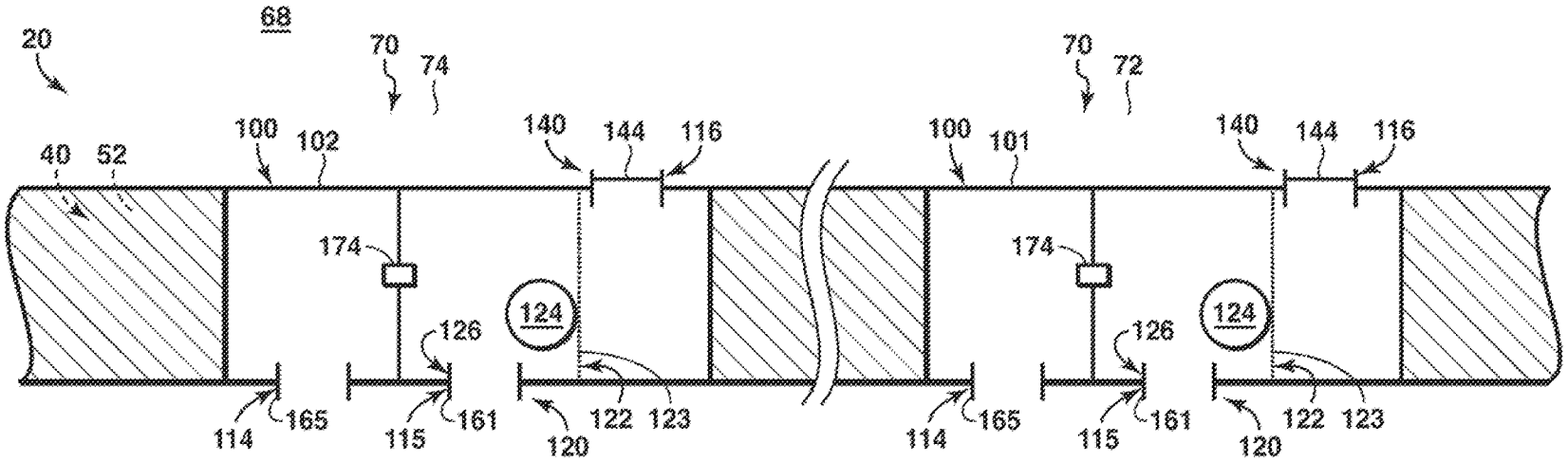
FIG. 9 provides less schematic but still illustrative, non-exclusive examples of a partial cross-sectional view of a casing string that includes two wellbore flow-control assemblies according to the present disclosure that are each associated with a respective region of a subterranean formation, wherein the casing string is configured for circulation of drilling fluids from a wellbore that includes the casing string.

In FIG. 9, sacrificial flow-control devices 140 of wellbore flow-control assemblies 100 are in the blocking configuration, with sacrificial bodies 144 attached thereto. In this configuration, wellbore flow-control assemblies 100 limit, block, and/or occlude fluid flow therethrough. Thus, and as discussed in more detail herein, a drilling fluid may be circulated from a wellbore that contains casing string 40 (as illustrated in FIG. 1) without a circulating fluid that is utilized to circulate the drilling fluid from the wellbore flowing through wellbore flow-control assemblies 100 and between casing conduit 44 and subterranean formation 68.

Figure 10:
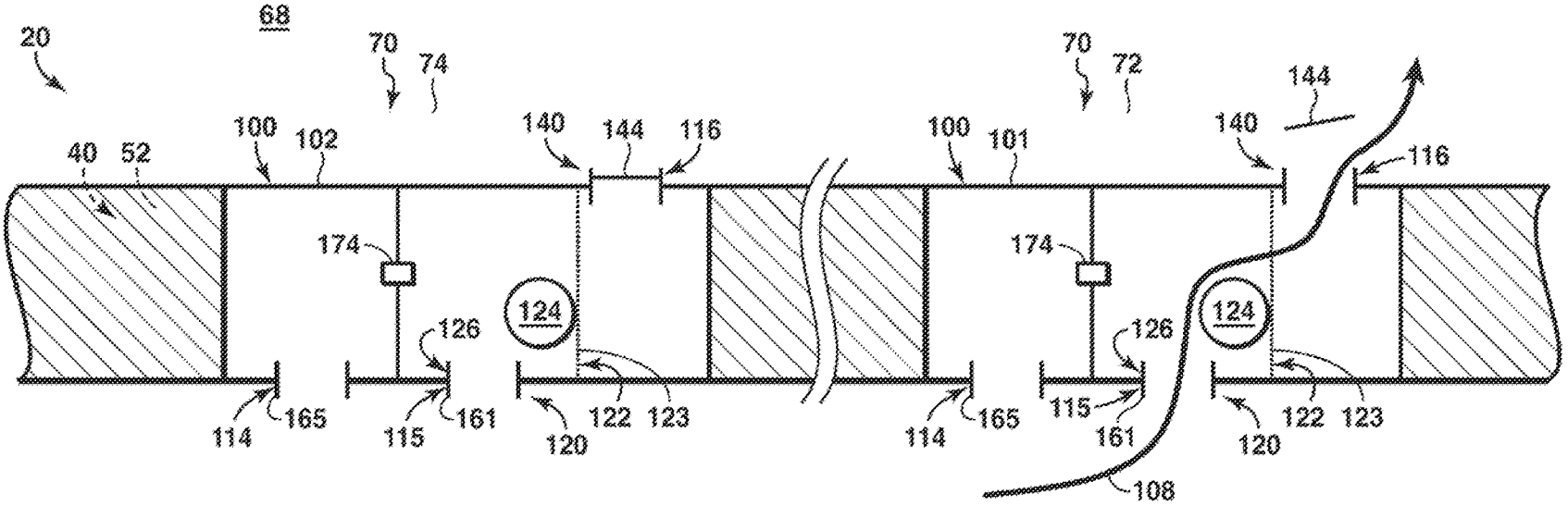
FIG. 10 provides additional less schematic but still illustrative, non-exclusive examples of the casing string of FIG. 9, wherein the first wellbore flow-control assembly is configured to stimulate a first region of the subterranean formation.

In FIG. 10, sacrificial flow-control device 140 of first wellbore flow-control assembly 101 has been transitioned to the flow configuration through removal of sacrificial body 144 therefrom (such as through generation of a first flow-initiation event that may include increasing a pressure within the casing conduit to be greater than a pressure within the subterranean formation by at least a first threshold amount). However, the sacrificial flow-control device of second wellbore flow-control assembly 102 remains in the blocking configuration. Thus, the first wellbore flow-control assembly defines a stimulation flow path 108, which is defined at least partially by internal stimulation opening 161, directional flow-control device 120, and sacrificial flow-control device 140 of the first wellbore flow-control assembly. The stimulation flow path permits stimulation of first region 72 of subterranean formation 68 independent from stimulation of second region 74 of the subterranean formation.

Figure 11:
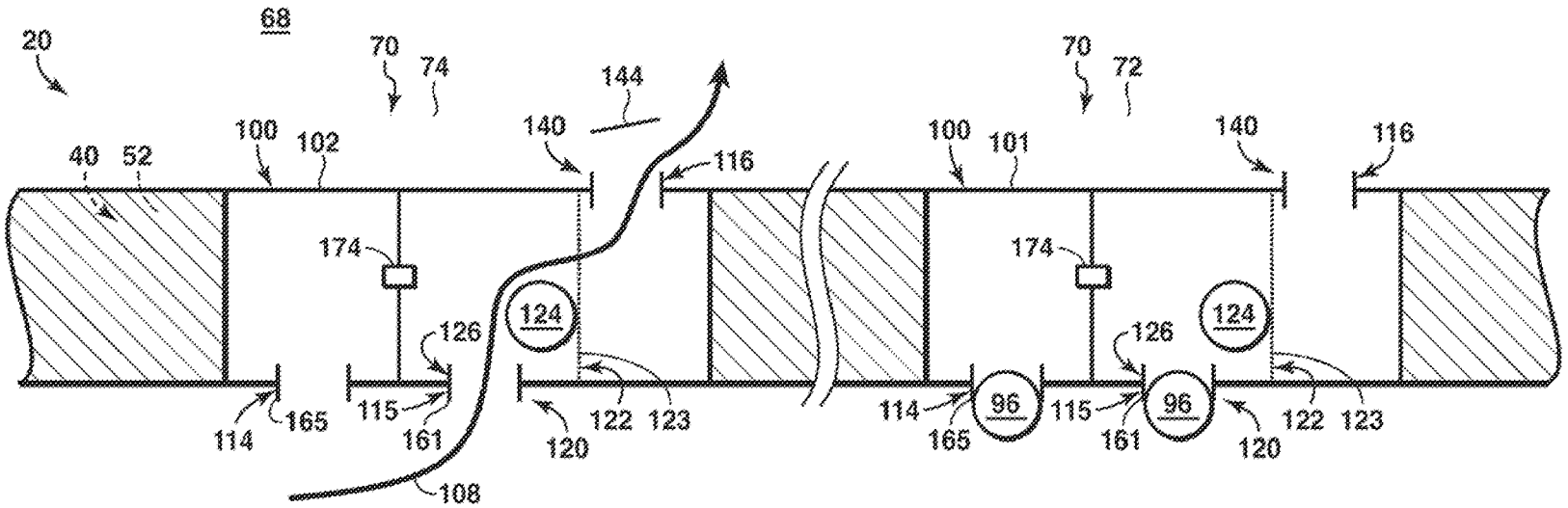
FIG. 11 provides additional less schematic but still illustrative, non-exclusive examples of the casing string of FIGS. 9-10, wherein the second wellbore flow-control assembly is configured to stimulate a second region of the subterranean formation.

In FIG. 11, ball sealers 96 have been provided to casing conduit 44 and internal production opening 165 and internal stimulation opening 161 of first wellbore flow-control assembly 101. This sealing permits generation of a positive pressure within wellbore conduit 44, which may provide for generation of a second flow-initiation event and transitioning sacrificial flow-control device 140 of second wellbore flow-control assembly 102 to the flow configuration, as shown. This permits stimulation of second region 74 of subterranean formation 68 independent from stimulation of first region 72 of the subterranean formation along stimulation flow path 108 of second wellbore flow-control assembly 102.

Figure 12:
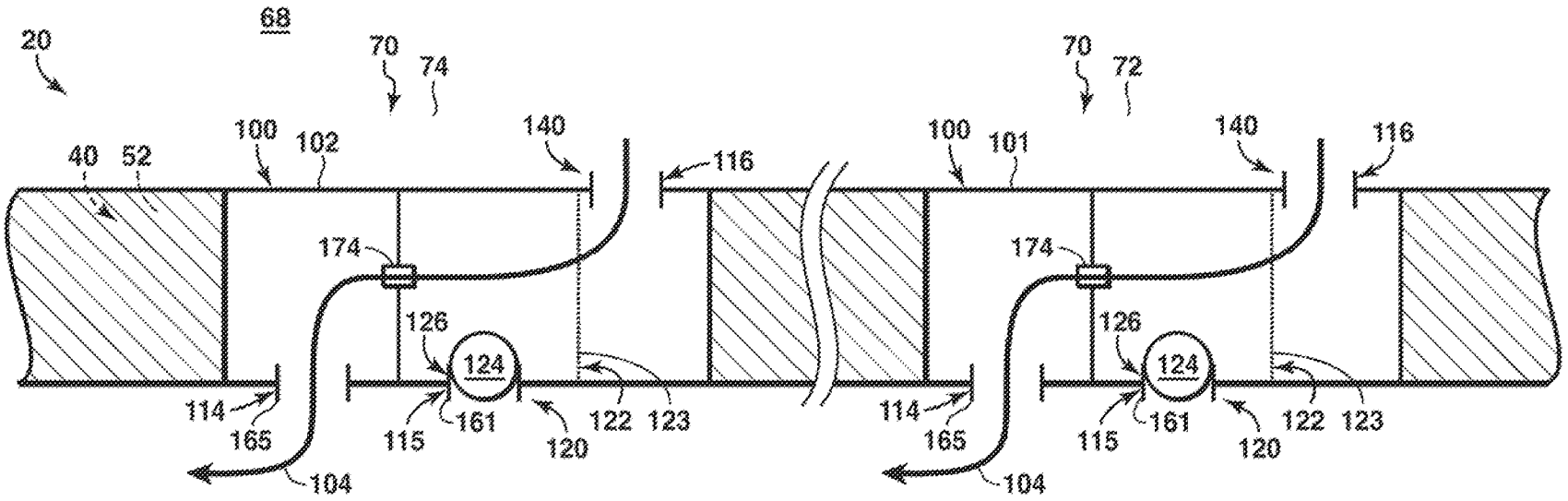
FIG. 12 provides additional less schematic but still illustrative, non-exclusive examples of the casing string of FIGS. 9-10, wherein both of the wellbore flow-control assemblies are configured to receive a reservoir fluid from the subterranean formation.

In FIG. 12 a pressure within casing conduit 44 has been decreased to a magnitude that is less than a pressure within subterranean formation 68, and a reservoir fluid flows along production flow paths 104 from the subterranean formation and into the casing conduit. The production flow paths, which are different from stimulation flow paths 108 of FIGS. 10-11, are defined, at least partially, by internal production opening 165, production orifice 174, and external opening 116 (and/or sacrificial flow-control device 140).

In addition, and as illustrated, the flow of reservoir fluid along the production flow path and/or a pressure differential between subterranean formation 68 and casing conduit 44 provides a motive force that urges ball 124 into seat 126, thereby sealing (or at least substantially sealing) internal stimulation opening 161 of wellbore flow-control assemblies 100 and limiting, blocking, preventing, and/or occluding flow of the reservoir fluid therethrough. This sealing provides for the above-described differences between production flow path 104 and stimulation flow path 108, thereby permitting independent control of production and stimulation flow rates and/or velocities, as discussed herein.

Figure 13:
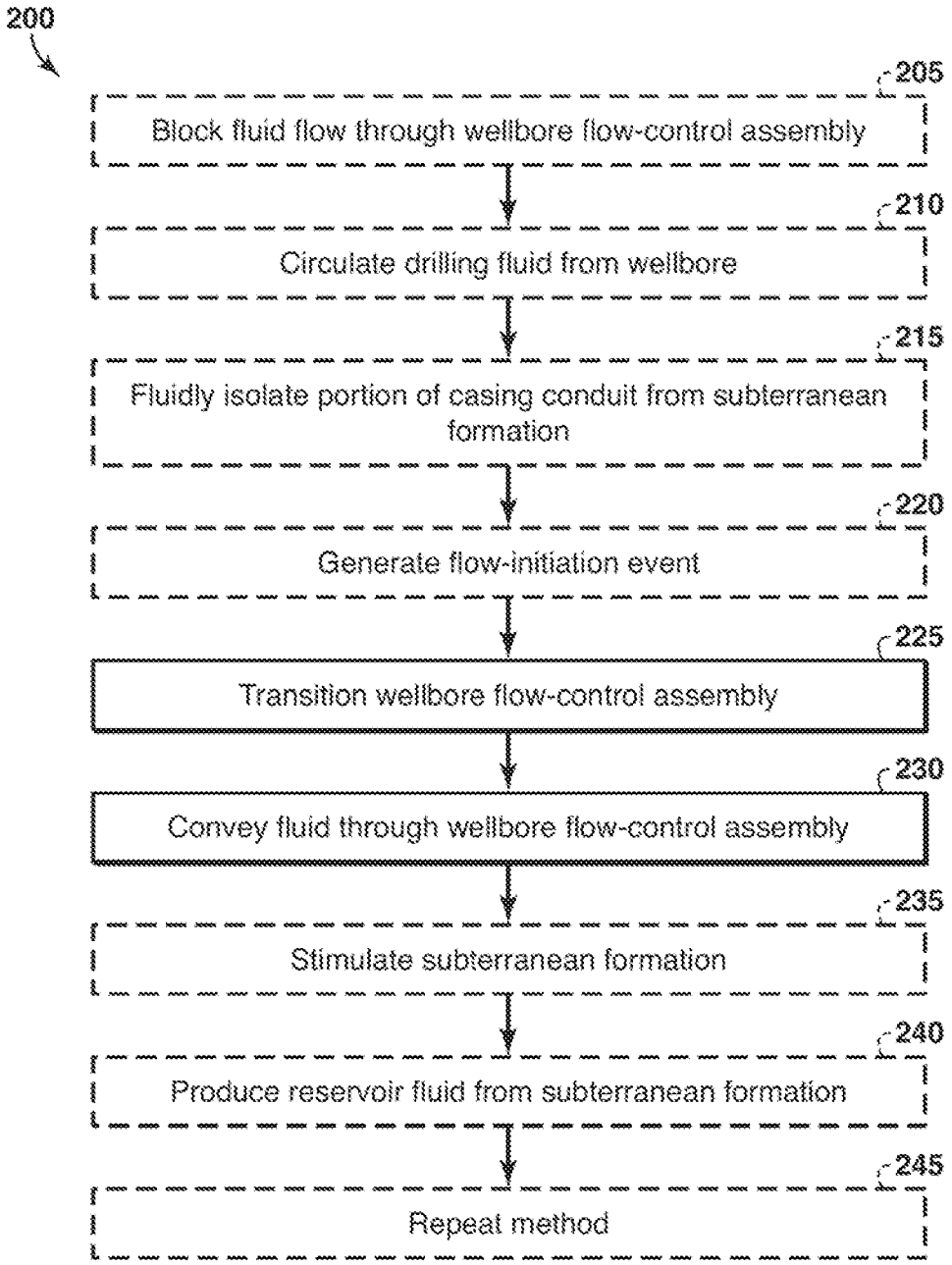
FIG. 13 is a flowchart depicting methods according to the present disclosure for circulating a drilling fluid from a wellbore, stimulating a subterranean formation that includes the wellbore, and/or producing a reservoir fluid from the subterranean formation.

FIG. 13 is a flowchart depicting methods 200 according to the present disclosure of circulating a drilling fluid from a wellbore that extends between a surface region and a subterranean formation, stimulating the subterranean formation, and/or producing a reservoir fluid from the subterranean formation. Methods 200 may include blocking a fluid flow through a wellbore flow-control assembly at 205, circulating a drilling fluid from the wellbore at 210, fluidly isolating a portion of a casing conduit, which is defined by a casing string that extends within the wellbore, from the subterranean formation at 215, and/or generating a flow-initiation event that may transition the wellbore flow-control assembly from a blocking configuration to a flow configuration at 220. Methods 200 further include transitioning the wellbore flow-control assembly from the blocking configuration to the flow configuration at 225 and conveying a fluid through the wellbore flow-control assembly at 230. Methods 200 further may include stimulating the subterranean formation at 235, producing the reservoir fluid from the subterranean formation at 240, and/or repeating the method at 245.

Blocking the fluid flow through the wellbore flow-control assembly at 205 may include limiting, restricting, and/or occluding the fluid flow through the wellbore flow-control assembly. It is within the scope of the present disclosure that the blocking may include blocking the fluid flow with a sacrificial flow-control device that forms a portion of the wellbore flow-control assembly. Illustrative, non-exclusive examples of sacrificial flow-control devices are discussed in more detail herein. As discussed, the blocking may include temporarily blocking the fluid flow, such as prior to the generating at 220 and/or the transitioning at 225, and may permit the circulating at 210 to be performed more efficiently than might otherwise be accomplished if the fluid flow through the wellbore flow-control assembly were not blocked.

As discussed in more detail herein, and subsequent to formation of the wellbore, the wellbore may contain a drilling fluid, and it may be desirable to remove the drilling fluid from the wellbore prior to stimulation of the subterranean formation and/or production of the reservoir fluid from the subterranean formation. Circulating the drilling fluid from the wellbore at 210 may include the use of any suitable system, method, and/or mechanism to convey and/or otherwise urge the drilling fluid from the wellbore and may be performed at any suitable time, such as prior to the generating at 220 and/or prior to the transitioning at 225.

As an illustrative, non-exclusive example, the circulating at 210 may include providing the circulating fluid from the surface region to a terminal end of the casing string through one of the casing conduit and an annular space that is defined between the casing string and the subterranean formation and/or receiving the circulating fluid from the other of the casing conduit and the annular space. It is within the scope of the present disclosure that a significant portion, or even all, of the circulating fluid may be transferred between the casing conduit and the annular space at the terminal end of the casing string. As illustrative, non-exclusive examples, at least a majority, at least 60%, at least 70%, at least 80%, at least 90%, at least 95%, or at least 99% of the circulating fluid may be transferred between the casing conduit and the annular space at the terminal end of the drilling string. Additionally or alternatively, the circulating also may include circulating the drilling fluid from the wellbore without flowing the drilling fluid and/or the circulating fluid through the wellbore flow-control assembly and/or circulating the drilling fluid from the wellbore without flowing the circulating fluid through a radial opening in the casing string, such as a radial opening that might extend between the casing conduit and the annular space.

To fluidly isolate a portion of the casing conduit from the subterranean formation at 215, any suitable structure, such as a sealing material, a plug, and/or ball sealers may be used to block, limit, and/or occlude fluid communication between the casing conduit and the subterranean formation. As an illustrative, non-exclusive example, the fluidly isolating may provide for and/or permit pressurization of the casing conduit, which, as discussed in more detail herein, may provide for, permit, and/or otherwise facilitate the generating at 220 and/or the transitioning at 225. As another illustrative, non-exclusive example, and subsequent to the circulating at 210, a plug may be set within the casing conduit to fluidly isolate a downhole portion of the casing conduit, which is in fluid communication with the subterranean formation, from an uphole portion of the casing conduit.

As yet another illustrative, non-exclusive example, and when the transitioning at 225 includes selectively transitioning one or more selected wellbore flow-control assemblies, as discussed in more detail herein, the fluidly isolating may include fluidly isolating a first zone of the casing conduit that includes the one or more selected wellbore flow-control assemblies from fluid communication with a second zone of the casing conduit that includes one or more remaining wellbore flow-control assemblies that have not been transitioned prior to transitioning a portion of the one or more remaining wellbore flow-control assemblies. As another illustrative, non-exclusive example, and when the transitioning at 225 includes the selectively transitioning, the fluidly isolating may include sealing the one or more selected wellbore flow-control assemblies with a sealing device, such as a ball sealer, without blocking, limiting, and/or occluding fluid flow within the casing conduit prior to transitioning a portion of the one or more remaining wellbore flow-control assemblies to the flow configuration.

Generating the flow-initiation event at 220 may include generating any suitable event that may result in, produce, cause, and/or bring about the transitioning at 225. As an illustrative, non-exclusive example, the generating may include pressurizing the casing conduit such that a pressure differential between the casing conduit and the subterranean formation, which may be defined as a difference between a pressure within the casing conduit and a pressure within the subterranean formation and/or a difference between a pressure on a casing conduit side of the wellbore flow-control assembly and a pressure on a subterranean formation side of the wellbore flow-control assembly, is at least a threshold positive pressure differential (i.e., the pressure within the casing conduit is greater than the pressure within the subterranean formation by at least the threshold positive pressure differential). Additionally or alternatively, the transitioning also may include depressurizing the casing conduit such that the pressure differential is less than a threshold negative pressure differential (i.e., the pressure within the casing conduit is less than the pressure within the subterranean formation by at least the threshold negative pressure differential).

It is within the scope of the present disclosure that a hydrocarbon well that includes the wellbore may include a plurality of wellbore flow-control assemblies. It is further within the scope of the present disclosure that each of the wellbore flow-control assemblies that is present within the wellbore may be designed, constructed, and/or configured to transition from the blocking configuration to the flow configuration responsive to the same, or at least substantially the same, flow-initiation event. However, it is also within the scope of the present disclosure that at least a first portion of wellbore flow-control assemblies may be designed, constructed, and/or configured to transition from the blocking configuration to the flow configuration responsive to a first flow-initiation event, that at least a second portion of the wellbore flow-control assemblies may be designed, constructed, and/or configured to transition from the blocking configuration to the flow configuration responsive to a second flow-initiation event, and that the first flow-initiation event may be different from, or have a different magnitude than, the second flow-initiation event. As an illustrative, non-exclusive example, the first portion of the wellbore flow-control assemblies may be configured to transition to the flow configuration at a first pressure differential, and the second portion of the wellbore flow-control assemblies may be configured to transition to the flow configuration at a second pressure differential that is different from, or greater than, the first pressure differential.

Transitioning the wellbore flow-control assembly at 225 may include transitioning the wellbore flow-control assembly from the blocking configuration, in which the fluid flow therethrough and between the casing conduit and the subterranean formation is blocked, occluded, and/or restricted, to the flow configuration, in which the fluid flow therethrough and between the casing conduit and the subterranean formation is permitted. As discussed in more detail herein, the wellbore flow-control assembly may include a sacrificial flow-control device that may resist the fluid flow prior to the transitioning and which may permit the fluid flow subsequent to the transitioning, and the transitioning may include altering, or altering a state of, the sacrificial flow-control device, to permit the fluid flow therethrough.

It is within the scope of the present disclosure that the transitioning may be based, at least in part, on any suitable criteria. As an illustrative, non-exclusive example, the transitioning may be responsive, or directly responsive, to the generating at 220, directly responsive to the pressure within the casing conduit, and/or directly responsive to the pressure differential. This may include transitioning without mechanically actuating the wellbore flow-control assembly and/or without transmitting a control signal, such as a wireless control signal, a radio control signal, and/or an electronic control signal, to the wellbore flow-control assembly.

Conveying the fluid flow through the wellbore flow-control assembly at 230 may include conveying the fluid flow through any suitable portion of the wellbore flow-control assembly subsequent to the transitioning at 225. As an illustrative, non-exclusive example, and as discussed in more detail herein, the wellbore flow-control assembly may include and/or define a flow-controlled fluid conduit that is configured to selectively convey the fluid flow, and the conveying may include conveying the fluid flow through the flow-controlled fluid conduit.

As also discussed in more detail herein, the sacrificial flow-control device may define a first portion of the flow-controlled fluid conduit, may resist the fluid flow through the flow-controlled fluid conduit prior to the transitioning at 225, and may permit the fluid flow through the flow-controlled fluid conduit subsequent to the transitioning at 225. When the sacrificial flow-control device defines the first portion of the flow-controlled fluid conduit, the conveying may include conveying the fluid flow through the first portion of the flow-controlled fluid conduit (i.e., through the sacrificial flow control device).

Additionally or alternatively, and as discussed, a directional flow-control device may define a second portion of the flow-controlled fluid conduit, may permit one of a fluid outflow and a fluid inflow through the flow-controlled fluid conduit, and may resist the other of the fluid outflow and the fluid inflow. When the directional flow-control device defines the second portion of the flow-controlled fluid conduit, the conveying may include conveying the fluid flow through the second portion of the flow-controlled fluid conduit (i.e., through the directional flow-control device).

Stimulating the subterranean formation at 235 may include providing, conveying, and/or flowing a stimulant fluid, such as a fracturing fluid, a proppant, and/or an acid, from the casing conduit and into the subterranean formation through the wellbore flow-control assembly. As an illustrative, non-exclusive example, and as discussed in more detail herein, the wellbore flow-control assembly may define a stimulation flow path that permits the fluid outflow from the casing conduit into the subterranean formation, and the stimulating may include providing the stimulant fluid through, or via, the stimulation flow path.

It is within the scope of the present disclosure that the stimulation flow path may include, or be defined by, any suitable portion, or component, of the wellbore flow-control assembly, such as a portion of the flow-controlled fluid conduit, the entire flow-controlled fluid conduit, a stimulation orifice, the directional flow-control device, the sacrificial flow-control device, and/or a stimulation port, with illustrative, non-exclusive examples of each of these components being discussed in more detail herein. It is further within the scope of the present disclosure that the stimulating may include providing, flowing, or conveying the stimulant fluid through any, or all, of these components of the wellbore flow-control assembly. In addition, and when the stimulating includes conveying the stimulant fluid through the directional flow-control device, methods 200 further may include resisting the fluid inflow with, or through, the directional flow-control device prior to, during, and/or after the stimulating.

Producing the reservoir fluid at 240 may include receiving, conveying, and/or flowing the reservoir fluid from the subterranean formation and into the casing conduit through the wellbore flow-control assembly. As an illustrative, non-exclusive example, and as discussed in more detail herein, the wellbore flow-control assembly may define a production flow path that permits the fluid inflow from the subterranean formation into the casing conduit, and the producing may include receiving the reservoir fluid through, or via, the production flow path and into the casing conduit.

When methods 200 include the fluidly isolating at 215 and the producing at 240, it is within the scope of the present disclosure that the producing may include removing any suitable fluid isolation device and/or sealing device from the casing conduit to permit the producing via the production flow path. As an illustrative, non-exclusive example, this may include removing a fluid isolation device, such as a plug, from the casing conduit. As another illustrative, non-exclusive example, this also may include removing one or more ball sealers from the casing conduit and/or displacing the one or more ball sealers from one or more internal production openings that are associated with the wellbore flow-control assemblies.

It is within the scope of the present disclosure that the production flow path may include, or be defined by, any suitable portion, or component, of the wellbore flow-control assembly, such as a portion of the flow-controlled fluid conduit, the entire flow-controlled fluid conduit, a production orifice, the directional flow-control device, the sacrificial flow-control device, and/or an inflow-control device, with illustrative, non-exclusive examples of each of these components being discussed in more detail herein. It is further within the scope of the present disclosure that the producing may include receiving, conveying, and/or flowing the reservoir fluid through any, or all, of these components of the wellbore flow-control assembly.

When the producing includes conveying the reservoir fluid through the directional flow-control device (and/or when the production flow path includes the directional flow-control device), the method further may include permitting the fluid inflow with the directional flow-control device and/or resisting the fluid outflow with the directional flow-control device. Under these conditions, the directional flow-control device also may be referred to herein as an inflow control device that may include and/or define the production orifice. Alternatively, and when the producing does not include conveying the reservoir fluid through the directional flow-control device (and/or when the production flow path does not include the directional flow-control device), the method further may include resisting the fluid inflow with the directional flow-control device.

It is within the scope of the present disclosure that methods 200 may include only one of the stimulating at 235 and the producing at 240. However, it is also within the scope of the present disclosure that methods 200 may include both the stimulating at 235 and the producing at 240. Generally, and when methods 200 include both the stimulating and the producing, the producing may be performed after, or subsequent to, the stimulating, though additionally or alternatively producing prior to the stimulating is also within the scope of the present disclosure.

As discussed in more detail herein, it is within the scope of the present disclosure that an individual wellbore flow-control assembly may be configured for one, but not both, of the stimulating at 235 and the producing at 240 (such as by including and/or defining one, but not both, of the stimulation flow path and the production flow path). Under these conditions, and when methods 200 include both the stimulating at 235 and the producing at 240, the stimulating and the producing may be performed by separate, distinct, and/or spaced-apart wellbore flow-control assemblies according to the present disclosure. This may include wellbore flow-control assemblies that are spaced apart around a circumference of a casing sub, as discussed in more detail herein.

Alternatively, and as also discussed in more detail herein, the individual wellbore flow-control assembly may be configured for both of the stimulating at 235 and the producing at 240 (such as by including and/or defining both the stimulation flow path and the production flow path). Under these conditions, the stimulation flow path may include the directional flow-control device and may be different from the production flow path. In addition, methods 200 further may include restricting the fluid inflow via the stimulation flow path during the producing (such as through the use of the directional flow-control device). Thus, the producing may include receiving the reservoir fluid into the casing conduit without flowing the reservoir fluid through the directional flow-control device, such as through the use of a bypass conduit that is internal to the wellbore flow-control assembly, bypasses the directional flow-control device, and forms a portion of the production flow path, as discussed in more detail herein.

When methods 200 include both the stimulating at 235 and the producing at 240, it is within the scope of the present disclosure that the wellbore flow-control assembly may be designed and/or configured to transition from the stimulating to the producing directly responsive to the pressure within the casing conduit and/or to the pressure differential. This may include transitioning from the stimulating to the producing without mechanically actuating the wellbore flow-control assembly (such as to close the stimulation port(s) therein), without delivering a wire line, coil tubing, or radio tag to the wellbore flow-control assembly from the surface region, and/or without transmitting a control signal, such as a wireless control signal, a radio control signal, and/or an electronic control signal, to the wellbore flow-control assembly.

Repeating the method at 245 may include repeating any suitable portion of the method based, at least in part, on any suitable criteria. As an illustrative, non-exclusive example, and as discussed in more detail herein, the casing string may include a plurality of wellbore flow-control assemblies that are arranged in a plurality of zones, and methods 200 may include fluidly isolating a first zone of the casing conduit that includes a first portion of the plurality of wellbore flow-control assemblies from fluid communication with the subterranean formation at 215, transitioning the first portion of the plurality of wellbore flow-control assemblies from the blocking configuration to the flow configuration at 225 (such as through generating a first flow-initiation event), and/or stimulating one or more first regions of the subterranean formation through the first portion of the plurality of wellbore flow-control assemblies at 235.

As an illustrative, non-exclusive example, the first portion of the plurality of wellbore flow-control assemblies may include at least 1%, at least 2%, at least 3%, at least 5%, at least 10%, at least 15%, or at least 20% of the plurality of wellbore flow-control assemblies. Additionally or alternatively, the first portion of the plurality of wellbore flow-control assemblies includes less than 50%, less than 40%, less than 30%, less than 25%, less than 20%, less than 15%, less than 10%, or less than 5% of the plurality of wellbore flow-control assemblies.

Subsequently, the repeating at 245 may include fluidly isolating a second zone of the casing conduit that is associated with a second portion of the plurality of wellbore flow-control assemblies from fluid communication with the subterranean formation at 215, transitioning the second portion of the plurality of wellbore flow-control assemblies from the blocking configuration to the flow configuration at 225 (such as by generating a second flow-initiation event), and/or stimulating one or more second regions of the subterranean formation through the second portion of the plurality of wellbore flow-control assemblies at 235.

This may be repeated any suitable number of times to transition any suitable number of portions of the plurality of wellbore flow-control assemblies and stimulate any suitable number of regions of the subterranean formation. In addition, methods 200 further may include maintaining wellbore flow-control assemblies that are associated with specific zones of the casing conduit in the blocking configuration until generation of respective flow-initiation events for respective wellbore flow-control assemblies. In addition, and subsequent to the stimulating, the repeating also may include producing the reservoir fluid from the subterranean formation through at least the first portion of the plurality of wellbore flow-control assemblies (i.e., from the first region of the subterranean formation) and the second portion of the plurality of wellbore flow-control assemblies (i.e., from the second region of the subterranean formation) at 240.

Figure 14:
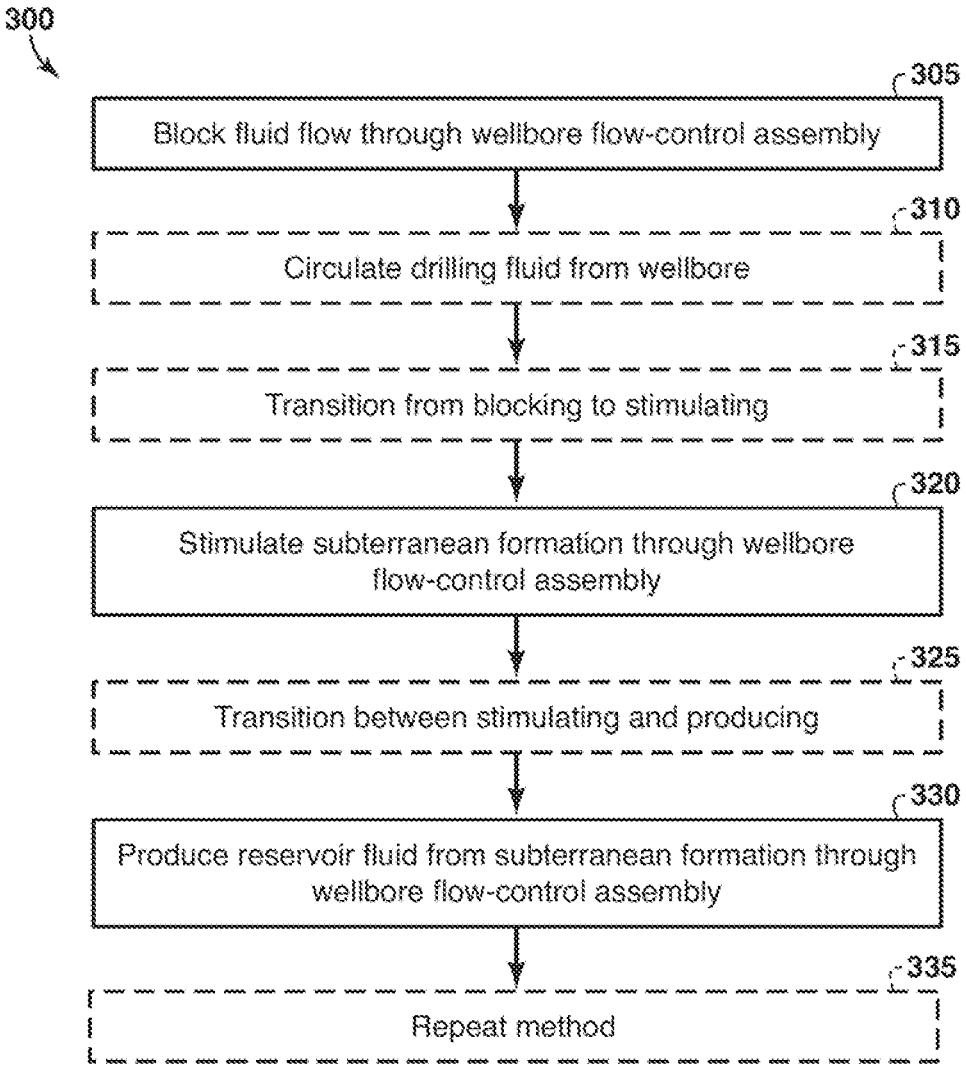
FIG. 14 is a flowchart depicting methods according to the present disclosure for controlling a fluid flow within a hydrocarbon well.

FIG. 14 is a flowchart depicting methods 300 according to the present disclosure of controlling a fluid flow in a hydrocarbon well. Methods 300 include blocking the fluid flow through a wellbore flow-control assembly that extends between a casing conduit and a subterranean formation at 305 and may include circulating a drilling fluid from a wellbore that contains a casing string that defines the casing conduit at 310 and/or transitioning at 315 from blocking the fluid flow at 305 to stimulating the subterranean formation at 320. Methods 300 further include stimulating the subterranean formation through the wellbore flow-control assembly with a stimulant fluid flow at a stimulant flow rate at 320 and may include transitioning at 325 between the stimulating at 320 and producing a reservoir fluid from the subterranean formation at 330. Methods 300 further include producing the reservoir fluid from the subterranean formation through the wellbore flow-control assembly at a production flow rate that is less than the stimulant flow rate at 330 and may include repeating the methods at 335.

Blocking the fluid flow through the wellbore flow-control assembly at 305 may include blocking the fluid flow prior to a flow-initiating event, and the methods further may include performing and/or generating the flow-initiation event (such as prior to the stimulating at 320 and/or the producing at 330) and/or permitting the fluid flow subsequent to the flow-initiation event. As an illustrative, non-exclusive example, and as discussed in more detail herein, the wellbore flow-control assembly may include a sacrificial flow-control device, which may block the fluid flow prior to the flow-initiation event and permit the fluid flow subsequent to the flow-initiation event.

Circulating the drilling fluid from the wellbore at 310 may be substantially similar to the circulating at 210, which is discussed in more detail herein with reference to methods 200, and may include providing any suitable circulating fluid to any suitable portion of the hydrocarbon well to circulate any suitable fluid therefrom and/or to provide any suitable fluid to the subterranean formation. It is within the scope of the present disclosure that the circulating may include circulating during the blocking at 305. Thus, the circulating may include flowing the circulating fluid along a length of the casing conduit, transferring the circulating fluid between the casing conduit and an annular space that is defined between the casing string and the subterranean formation at a terminal end of the casing string, and/or transferring the circulating fluid between the casing conduit and the annular space without flowing the circulating fluid through the wellbore flow-control assembly.

Transitioning from the blocking to the stimulating at 315 may include generating a flow-initiation event. As discussed in more detail herein, this may include increasing a pressure within the casing conduit to be greater than a pressure within the subterranean formation by at least a threshold positive pressure differential. Additionally or alternatively, the transitioning at 315 also may include generating a release event. As discussed in more detail herein, this may include decreasing the pressure within the casing conduit to be less than the pressure within the subterranean formation by at least a threshold negative pressure differential.

Stimulating the subterranean formation at 320 may be substantially similar to the stimulating at 235, which is discussed in more detail herein with reference to methods 200, and may include flowing any suitable stimulation fluid through the wellbore flow-control assembly and from the casing conduit into the subterranean formation. As discussed in more detail herein, the wellbore flow-control assembly may include and/or define a stimulation orifice, and the stimulating may include flowing the stimulant fluid through the stimulation orifice to control the stimulant flow rate and/or a velocity of the stimulant fluid as it enters the subterranean formation. As also discussed in more detail herein, the stimulating also may include flowing the stimulant fluid through the, or the entire, flow-controlled fluid conduit. It is within the scope of the present disclosure that, during the stimulating, the method further may include maintaining the pressure within the casing conduit at or above a stimulating pressure that is greater than the pressure within the subterranean formation, which may provide a motive force for the stimulant fluid flow from the casing conduit, through the wellbore flow-control assembly, and into the subterranean formation.

Transitioning between the stimulating and the producing at 325 may include decreasing the pressure within the casing conduit to be less than the pressure within the subterranean formation and/or maintaining the pressure within the casing conduit at and/or below a producing pressure that is less than the pressure within the subterranean formation. Additionally or alternatively, transitioning between the stimulating and the producing at 325 may include increasing the pressure within the casing conduit to be greater than the pressure within the subterranean formation and/or maintaining the pressure within the casing conduit above the stimulating pressure.

Producing the reservoir fluid from the subterranean formation at 330 may be substantially similar to the producing at 240, which is discussed in more detail herein with reference to methods 200, and may include receiving the reservoir fluid from the subterranean formation and into the casing conduit by flowing the reservoir fluid through the wellbore flow-control assembly and/or at least a portion of the flow-controlled fluid conduit thereof. As discussed in more detail herein, the wellbore flow-control assembly may include and/or define a production orifice, and the producing may include flowing the reservoir fluid through the production orifice to control the production flow rate and/or a velocity of the reservoir fluid as it enters the casing conduit. In addition, and as also discussed, the producing may include producing the reservoir fluid without flowing the reservoir fluid through the stimulation orifice.

Additionally or alternatively, the producing also may include producing the reservoir fluid without flowing the reservoir fluid through a directional flow-control device that defines a portion of the flow-controlled fluid conduit. It is within the scope of the present disclosure that, during the producing, subsequent to the transitioning at 315, and/or subsequent to the stimulating at 320, the methods further may include maintaining the pressure within the casing conduit below the producing pressure, which may provide a motive force for flow of the reservoir fluid from the subterranean formation, through the wellbore flow-control assembly, and into the casing conduit.

Repeating the method at 335 may include repeating any suitable portion of the method and may be substantially similar to the repeating at 245, which is discussed in more detail herein with reference to methods 200. As an illustrative, non-exclusive example, and as discussed, a hydrocarbon well that extends within the subterranean formation may include a plurality of wellbore flow-control assemblies that are present in a plurality of zones of the casing conduit and associated with a plurality of regions of the subterranean formation. Under these conditions, methods 300 may include transitioning a first portion of the plurality of wellbore flow-control assemblies from the blocking configuration to the flow configuration at 315 and stimulating a first region of the subterranean formation via the first portion of the plurality of wellbore flow-control assemblies at 320. Later, a second, or subsequent, portion of the plurality of wellbore flow-control assemblies may be transitioned from the blocking configuration to the flow configuration at 315 and a second, or subsequent, region of the subterranean formation may be stimulated via the second, or subsequent, portion of the plurality of wellbore flow-control assemblies at 320. After stimulation of a selected number (or all) of the plurality of regions of the subterranean formation, methods 300 may then include producing the reservoir fluid from the subterranean formation at 330.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A wellbore flow-control assembly, comprising:

a flow-controlled fluid conduit in a wellbore tubular that selectively conveys a fluid flow between a subterranean formation and a casing conduit, wherein the fluid flow includes at least one of a fluid outflow from the casing conduit into the subterranean formation defining a stimulation fluid flow path and a fluid inflow from the subterranean formation into the casing conduit defining a production fluid flow path;

a sacrificial flow-control device that defines a first portion of the flow-controlled fluid conduit, resists the fluid flow through the flow-controlled fluid conduit prior to occurrence of a flow-initiation event and permits the fluid flow through the flow-controlled fluid conduit subsequent to the flow-initiation event; and a directional flow-control device that defines a second portion of the flow-controlled fluid conduit, permits one of the fluid outflow and the fluid inflow through the flow-controlled fluid conduit, and resists the other of the fluid outflow and the fluid inflow through the flow-controlled fluid conduit;

a by-pass conduit that defines another portion of the flow-controlled fluid conduit permitting the fluid outflow or the fluid inflow through the flow-controlled fluid conduit when the directional flow-control device allows the other of the fluid outflow or the fluid inflow, wherein the sacrificial flow-controlled device resists fluid flow through the by-pass conduit prior to the occurrence of the flow-initiation event.

2. The wellbore flow-control assembly of claim 1, wherein the stimulation flow path includes the entire flow-controlled fluid conduit, and further wherein the directional flow-control device is configured to permit the fluid outflow and to resist the fluid inflow.

3. The wellbore flow-control assembly of claim 2, wherein the directional flow-control device includes a ball sealer that is configured to selectively restrict the fluid inflow, and further wherein the directional flow-control device further includes a retaining structure that is configured to retain the ball sealer within the directional flow-control device.

4. The wellbore flow-control assembly of claim 2, wherein the stimulation flow path includes a stimulation orifice that defines a stimulation orifice characteristic dimension of at least 12 mm and less than 40 mm.

5. The wellbore flow-control assembly of claim 1, wherein the production flow path includes the entire flow-controlled fluid conduit, and further wherein the directional flow-control device is configured to permit the fluid inflow and to resist the fluid outflow.

6. The wellbore flow-control assembly of claim 1, wherein the production flow path includes a production orifice that defines a production orifice characteristic dimension of at least 1 mm and less than 6 mm.

7. The wellbore flow-control assembly of claim 1, wherein the production flow path includes at least a portion of the flow-controlled fluid conduit, and further wherein the directional flow-control device permits fluid outflow from the casing conduit through the at least a portion of the flow-controlled fluid conduit and the by-pass conduit permits fluid outflow from the casing conduit through the another portion of the flow-controlled fluid conduit.

8. The wellbore flow-control assembly of claim 1, wherein the wellbore flow-control assembly defines the stimulation flow path and the production flow path, wherein the stimulation flow path is partially coextensive with the production flow path.

9. The wellbore flow-control assembly of claim 8, wherein the wellbore flow-control assembly defines a plurality of internal openings including at least an internal stimulation opening, which defines a portion of the stimulation flow path, and an internal production opening, which defines a portion of the production flow path, wherein the plurality of internal openings is defined by an internal surface of a casing string that defines the casing conduit, and further wherein the plurality of internal openings provides fluid communication between the flow-controlled fluid conduit and the casing conduit.

10. The wellbore flow-control assembly of claim 9, wherein a production orifice, which defines a portion of the production flow path, is internal to the wellbore flow-control assembly and provides fluid communication between the internal stimulation opening and the internal production opening.

11. The wellbore flow-control assembly of claim 9, wherein the plurality of internal openings defines a plurality of ball seats within the casing conduit that are configured to be sealed by a plurality of ball sealers.

12. The wellbore flow-control assembly of claim 1, wherein the sacrificial flow-control device includes a structure that transitions from the blocking configuration to the flow configuration only a single time or transitions from the blocking configuration to the flow configuration through partial destruction.

13. The wellbore flow-control assembly of claim 1, wherein the sacrificial flow-control device includes a sacrificial body that is removed from the sacrificial flow-control device subsequent to the flow-initiation event, wherein the wellbore flow-control assembly further includes a retaining collar that is sized to retain the sacrificial body within the wellbore flow-control assembly subsequent to the flow-initiation event and to release the sacrificial body from the wellbore flow-control assembly subsequent to a release event, wherein the flow-initiation event includes a casing conduit pressure that is greater than a subterranean formation pressure, and further wherein the release event includes a casing conduit pressure that is less than the subterranean formation pressure.

14. The wellbore flow-control assembly of claim 1, wherein the flow-initiation event includes a pressure differential between the casing conduit and the subterranean formation that is greater than a threshold pressure differential.

15. A hydrocarbon well comprising:

the wellbore flow-control assembly of claim 1;

a casing string that includes the wellbore flow-control assembly and defines the casing conduit; and a wellbore that contains the casing string.

16. A method of completing a hydrocarbon well having a wellbore and a casing string within the wellbore that defines a casing conduit, the method comprising:

transitioning a flow-control assembly, which comprises a flow-controlled fluid conduit, from blocking configuration, in which a fluid flow between the casing conduit and a subterranean formation is restricted, to a flow configuration, in which the fluid flow between the casing conduit and the subterranean formation is permitted, wherein the flow-control assembly includes a directional flow-control device that permits one of a fluid outflow from the casing conduit and a fluid inflow into the casing conduit and selectively resists the other of the fluid outflow and the fluid inflow, and a sacrificial flow-control device that resists the fluid flow from the casing conduit prior to the transitioning and permits the fluid flow from the casing conduit subsequent to the transitioning;

providing a by-pass conduit within the flow-controlled fluid conduit, the by-pass conduit permitting the fluid outflow or the fluid inflow through the flow-controlled fluid conduit subsequent to the transitioning and subsequent to the directional flow-control device resisting the same of the fluid outflow or the fluid inflow through the flow-controlled conduit; and conveying at least one of the fluid outflow and the fluid inflow through the flow-controlled fluid conduit, including the fluid by-pass conduit, subsequent to the transitioning.

17. The method of claim 16, wherein the flow-controlled fluid conduit selectively conveys the fluid flow between the subterranean formation and the casing conduit, wherein the sacrificial flow-control device defines a first portion of the flow-controlled fluid conduit, wherein the directional flow-control device defines a second portion of the flow-controlled fluid conduit, and further wherein the conveying includes conveying the fluid flow through the first portion of the flow-controlled fluid conduit and through the second portion of the flow-controlled fluid conduit.

18. The method of claim 16, wherein, prior to the transitioning, the method further includes circulating a drilling fluid from the wellbore, wherein the circulating includes providing a circulating fluid from a surface region to a terminal end of the casing string by providing the circulating fluid to one of the casing conduit and an annular space that extends between the casing string and the subterranean formation, wherein the method further includes receiving the circulating fluid from the other of the casing conduit and the annular space, and further wherein the circulating includes transferring at least a majority of the circulating fluid between the casing conduit and the annular space at the terminal end of the casing string.

19. The method of claim 18, wherein the circulating does not include inserting an inner string into the casing conduit.

20. The method of claim 16, wherein the wellbore flow-control assembly defines a stimulation flow path, wherein the stimulation flow path includes the directional flow-control device, which is configured to permit the fluid outflow and to resist the fluid inflow, and further wherein the method includes stimulating the subterranean formation by providing a stimulant fluid from the casing conduit and into the subterranean formation via the stimulation flow path.

21. The method of claim 16, wherein the wellbore flow-control assembly defines a production flow path, wherein the production flow path does not include the directional flow-control device, and further wherein the method includes producing a reservoir fluid by receiving the reservoir fluid from the subterranean formation and into the casing conduit via the production flow path.

22. The method of claim 16, wherein the wellbore flow-control assembly defines a production flow path, wherein the production flow path includes a production orifice and the flow-controlled fluid conduit, wherein the conveying includes conveying the fluid inflow, and further wherein the method includes resisting the fluid outflow with the directional flow-control device.

23. The method of claim 16, wherein the wellbore flow-control assembly includes a stimulation flow path and a production flow path that is partially coextensive with the stimulation flow path, wherein the method includes stimulating the subterranean formation via the stimulation flow path, and further wherein the method includes producing a reservoir fluid from the subterranean formation via the production flow path.

24. The method of claim 16, wherein the casing string includes a plurality of wellbore flow-control assemblies, wherein the plurality of wellbore flow-control assemblies is arranged in a plurality of zones, wherein the plurality of zones includes at least a first zone that includes a first portion of the plurality of wellbore flow-control assemblies that is configured to selectively transition to the flow configuration and provide fluid communication with a first region of the subterranean formation responsive to a first flow-initiation event and a second zone that includes a second portion of the plurality of wellbore flow-control assemblies that is configured to selectively transition to the flow configuration and provide fluid communication with a second region of the subterranean formation responsive to a second flow-initiation event that is different from the first flow-initiation event, and further wherein the transitioning includes transitioning the first portion of the plurality of wellbore flow-control assemblies from the blocking configuration to the flow configuration without transitioning the second portion of the plurality of wellbore flow-control assemblies from the blocking configuration to the flow configuration.

25. The method of claim 24, wherein the method further includes fluidly isolating the first zone from fluid communication with the subterranean formation, wherein the transitioning includes transitioning the first portion of the plurality of wellbore flow-control assemblies by generating the first flow-initiation event, wherein the method further includes maintaining the second portion of the plurality of wellbore flow-control assemblies in the blocking configuration subsequent to the first flow-initiation event and prior to the second flow-initiation event, and further wherein the method includes stimulating the first region of the subterranean formation.

26. The method of claim 25, wherein the method further includes fluidly isolating the second zone of the plurality of zones from fluid communication with the subterranean formation, transitioning the second portion of the plurality of wellbore flow-control assemblies to the flow configuration by generating the second flow-initiation event, and stimulating the second region of the subterranean formation.

27. The method of claim 26, wherein the method further includes producing a reservoir fluid from the first region of the subterranean formation and the second region of the subterranean formation subsequent to the stimulating the first region and the stimulating the second region.

28. The method of claim 16, wherein the method further includes generating the flow-initiation event and transitioning directly responsive to the flow-initiation event, wherein the flow-initiation event includes increasing a pressure differential between the casing conduit and the subterranean formation.

29. The method of claim 28, wherein the method further includes generating a release event to separate a sacrificial body from the wellbore flow-control assembly, wherein the release event includes providing a motive force through the flow-controlled fluid conduit for removing the sacrificial body from the wellbore flow-controlled fluid conduit.

30. A method of controlling a fluid flow in a hydrocarbon well, the method comprising:

blocking a fluid flow through a wellbore flow-control assembly that defines a flow-controlled fluid conduit that extends between a casing conduit and a subterranean formation;

stimulating the subterranean formation through the wellbore flow-control assembly with a stimulant fluid flow at a stimulant flow rate;

producing a reservoir fluid from the subterranean formation through the wellbore flow-control assembly at a production flow rate;

transitioning from one of the blocking, stimulating, and producing to another of the blocking, stimulating, and producing by changing the pressure within the casing conduit relative to a pressure within the subterranean formation by at least a threshold pressure differential; and wherein the stimulating includes flowing the stimulant fluid flow through the flow-controlled fluid conduit, wherein flow-controlled fluid conduit includes a stimulation orifice, and further wherein the producing includes flowing the production fluid flow through a portion of the flow-controlled fluid conduit including a by-pass conduit that does not include the stimulation orifice.

31. The method of claim 30, wherein the blocking includes blocking prior to a flow-initiation event, and further wherein the method includes generating the flow-initiation event subsequent to the blocking but prior to the stimulating and the producing.

32. The method of claim 30, wherein the casing conduit extends within a wellbore, and further wherein, during the blocking, the method further includes circulating a drilling fluid from the wellbore.

33. The method of claim 30, wherein the method further includes transitioning from the blocking to the stimulating, wherein the transitioning from the blocking to the stimulating includes increasing a pressure within the casing conduit to be greater than a pressure within the subterranean formation by at least a threshold pressure differential.

34. The method of claim 33, wherein the transitioning from the blocking to the stimulating further includes decreasing the pressure within the casing conduit to be less than the pressure within the subterranean formation by at least a threshold pressure differential.

35. The method of claim 30, wherein the method further includes transitioning from the stimulating to the producing, wherein the transitioning from the stimulating to the producing includes decreasing a pressure within the casing conduit to be less than a pressure within the subterranean formation and maintaining the pressure within the casing conduit below a producing pressure.

36. The method of claim 35, wherein the transitioning from stimulating to producing does not include sending sealing structures from a surface region or mechanically actuating the wellbore flow-control assembly from the surface region.

37. The method of claim 30, wherein the method further includes transitioning from the producing to the stimulating, wherein the transitioning from the producing to the stimulating includes increasing a pressure within the casing conduit to be greater than a pressure within the subterranean formation and maintaining the pressure within the casing conduit above a stimulating pressure.

* * * * *